US005610587A

United States Patent [19]

Fujiuchi et al.

[11] Patent Number: 5,610,587

[45] Date of Patent: Mar. 11, 1997

[54] THEFT PREVENTIVE APPARATUS HAVING AN ALARM OUTPUT DEVICE

[75] Inventors: Hiroyuki Fujiuchi; Masaaki Takeshita; Kenji Uchida, all of Osaka; Tsutomu Ida; Hisakazu Okumura, both of Tomioka; Mitsuhiko Nakajima, Nagano-ken, all of Japan

[73] Assignee: Kubota Corporation, Osaka, Japan

[21] Appl. No.: 428,108

[22] PCT Filed: Aug. 25, 1994

[86] PCT No.: PCT/JP94/01406

§ 371 Date: Apr. 27, 1995

§ 102(e) Date: Apr. 27, 1995

[87] PCT Pub. No.: WO95/06923

PCT Pub. Date: Mar. 9, 1995

[30] Foreign Application Priority Data

| | | | |
|---|---|---|---|
| Aug. 31, 1993 | [JP] | Japan | 5-215882 |
| Aug. 31, 1993 | [JP] | Japan | 5-215884 |
| Aug. 31, 1993 | [JP] | Japan | 5-215885 |
| Aug. 31, 1993 | [JP] | Japan | 5-215886 |
| Aug. 31, 1993 | [JP] | Japan | 5-215887 |
| Aug. 31, 1993 | [JP] | Japan | 5-215888 |

[51] Int. Cl.[6] ..... G08B 13/06

[52] U.S. Cl. ..... 340/572; 70/57.1; 340/568; 340/571

[58] Field of Search ..... 340/572, 571, 340/568; 70/57.1

[56] References Cited

U.S. PATENT DOCUMENTS

| | | | |
|---|---|---|---|
| 4,000,543 | 1/1977 | Paskert | 340/572 |
| 4,274,088 | 6/1981 | Pierson et al. | 340/568 |
| 4,987,754 | 1/1991 | Minasy | 70/57.1 |
| 4,992,776 | 2/1991 | Crossfield | 340/572 |

FOREIGN PATENT DOCUMENTS

| | | | |
|---|---|---|---|
| 0385800 | 9/1990 | European Pat. Off. | G08B 13/12 |
| 52-82094 | 7/1977 | Japan . | |
| 55-89192 | 12/1978 | Japan . | |
| 61-160583 | 10/1986 | Japan . | |
| 62-285328 | 12/1987 | Japan . | |
| 63-195493 | 12/1988 | Japan . | |
| 2-260098 | 10/1990 | Japan . | |
| 4-20192 | 2/1992 | Japan . | |
| 4-211897 | 8/1992 | Japan . | |
| 1015700 | 1/1966 | United Kingdom . | |

OTHER PUBLICATIONS

Patent Abstracts of Japan, vol. 105, No. 246 (E-1081), Jun. 24, 1991; JP-A-03 077219 (Omron Corp), Apr. 2, 1991.

*Primary Examiner*—Glen Swann

*Attorney, Agent, or Firm*—Townsend and Townsend and Crew LLP

[57] ABSTRACT

A theft preventive apparatus is attached to a commodity or the like exhibited in a shop, for outputting an alarm when detached therefrom.

Conventionally, a battery is used as a power source for driving an alarm output device, and power supply is turned on and off by moving the battery. Even in a non-use state, an operation could be started inadvertently by vibration or the like.

The theft preventive apparatus of this invention includes an attached state detecting device (3, 103) exposed outside a box (2) for detecting a state of attachment to an object of theft prevention, alarm output means (G) mounted in said box (2) for detecting removal of said box (2) from the object of theft prevention based on information from said attached state detecting device (3, 103), and outputting an alarm in time of detection of the removal, a battery (V) mounted in said box (2) for driving said alarm output means (G), and a power supply switch (6) for turning power supply on and off between said battery (V) and said alarm output means (G). Consequently, by turning off the power supply switch, the theft preventive apparatus, even in a non-use state, does not start operating inadvertently by vibration or the like, thereby avoiding wasteful consumption of battery power.

16 Claims, 17 Drawing Sheets

FIG.10
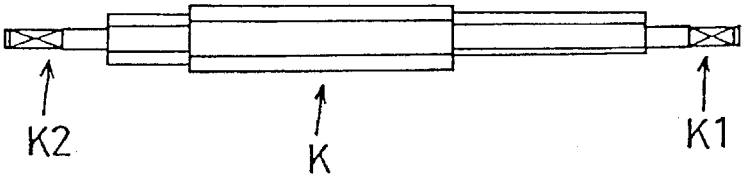
FIG.11
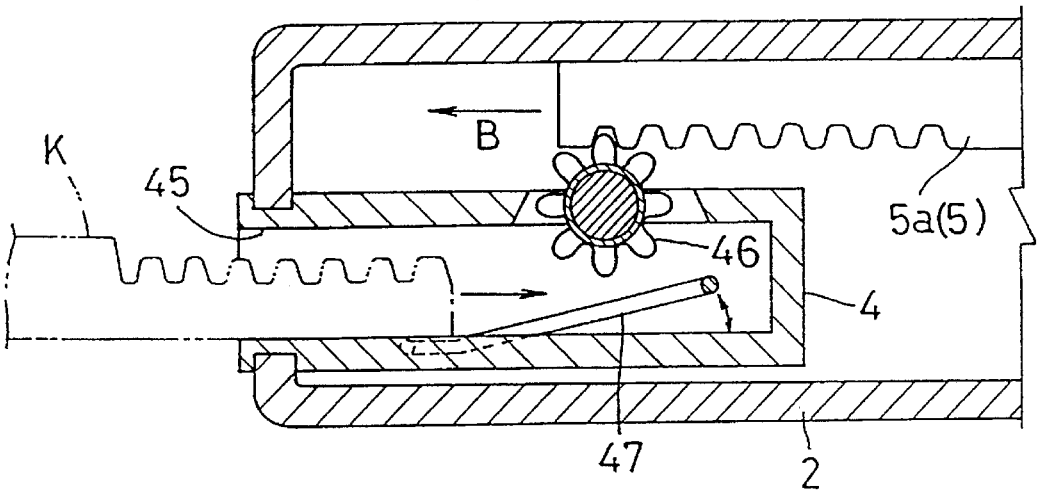
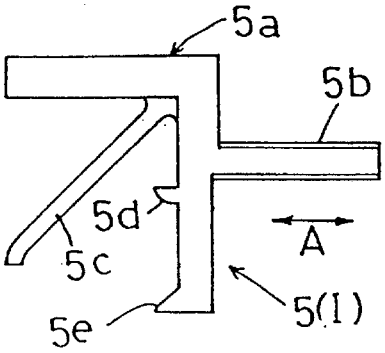
FIG. 12A.
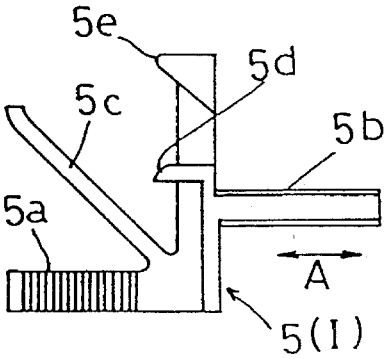
FIG. 12B.

FIG. 19A.
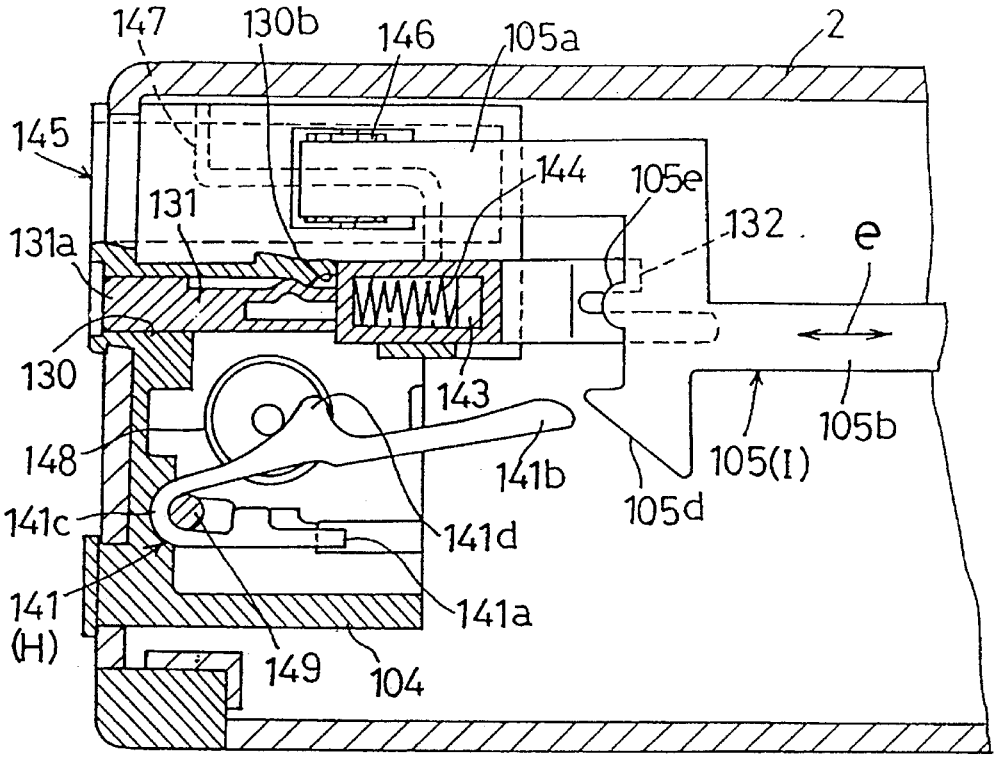
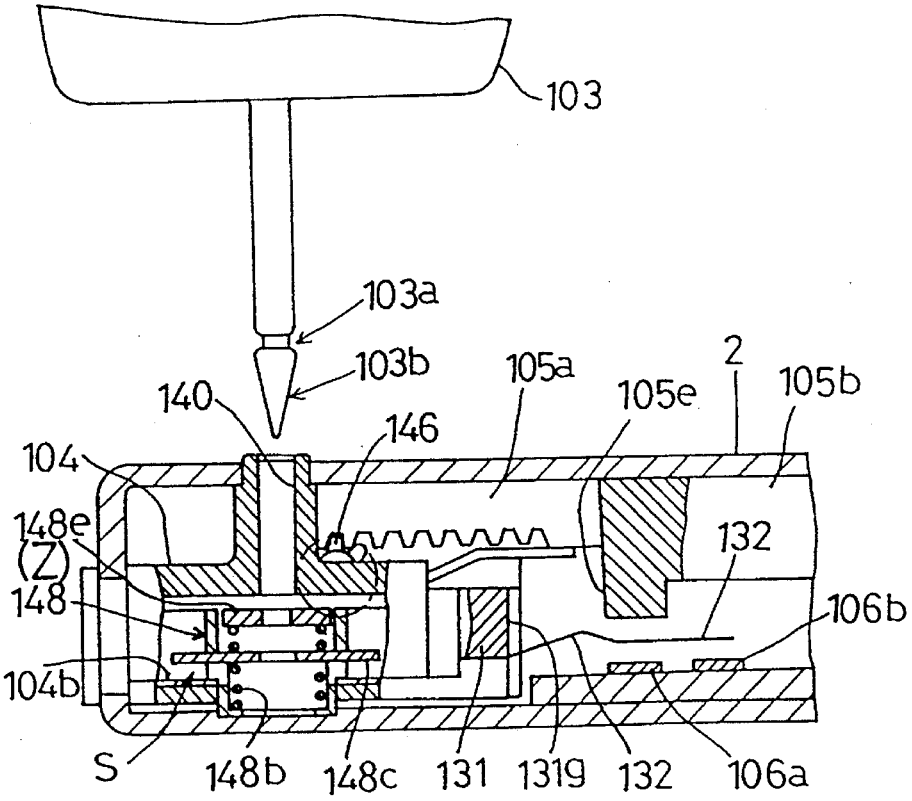
FIG. 19B.

FIG. 20A.
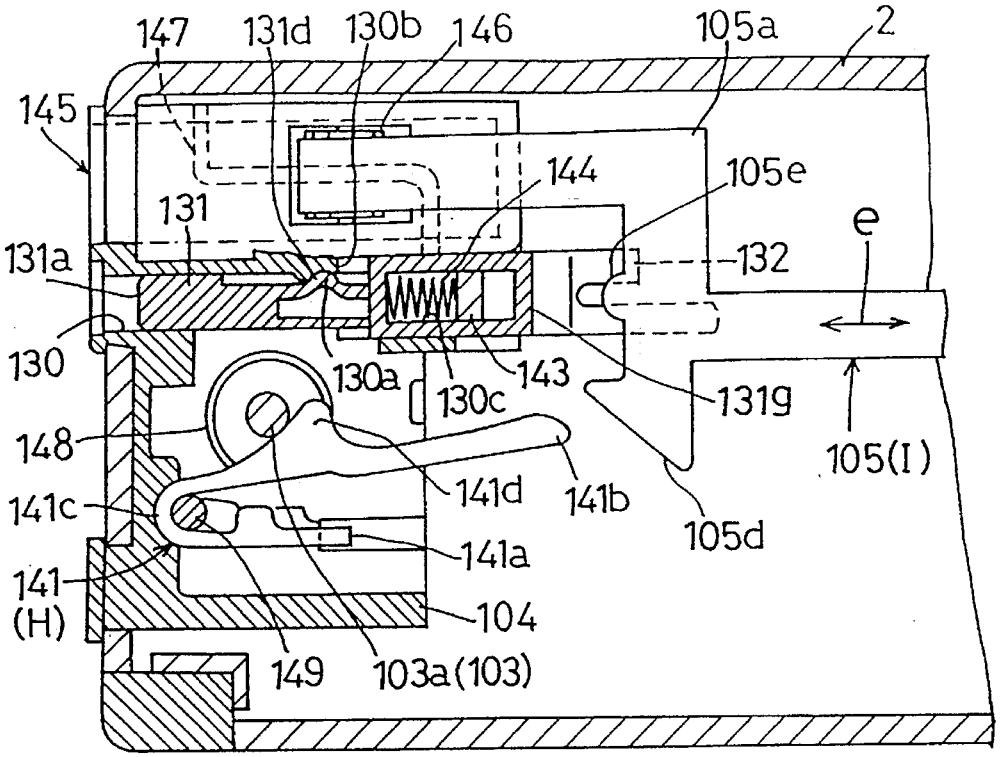
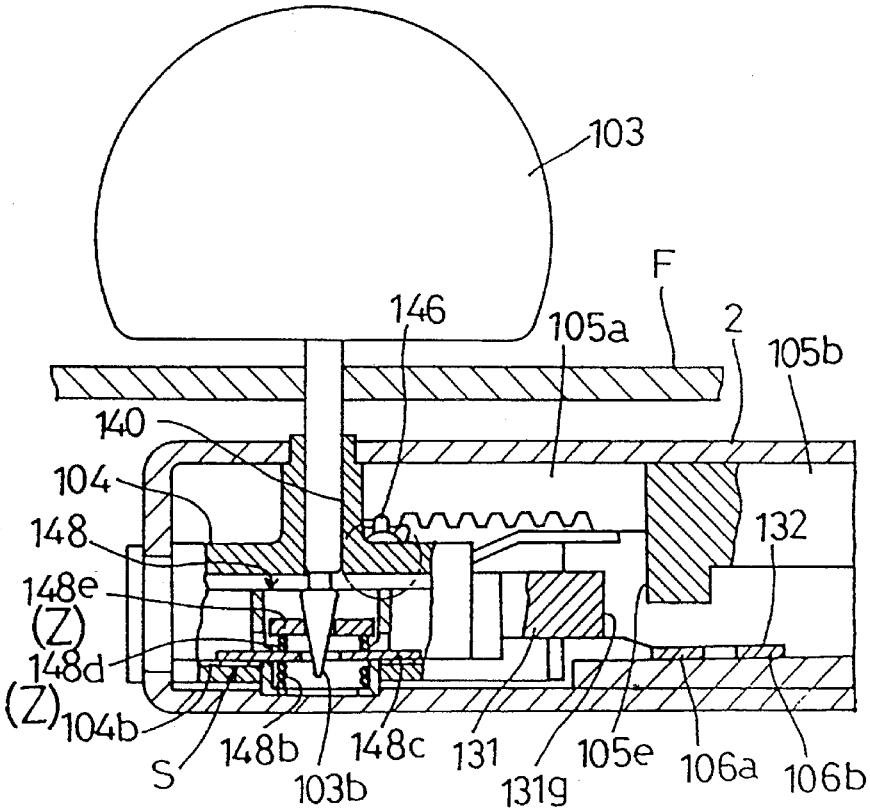
FIG. 20B.

FIG. 21A.
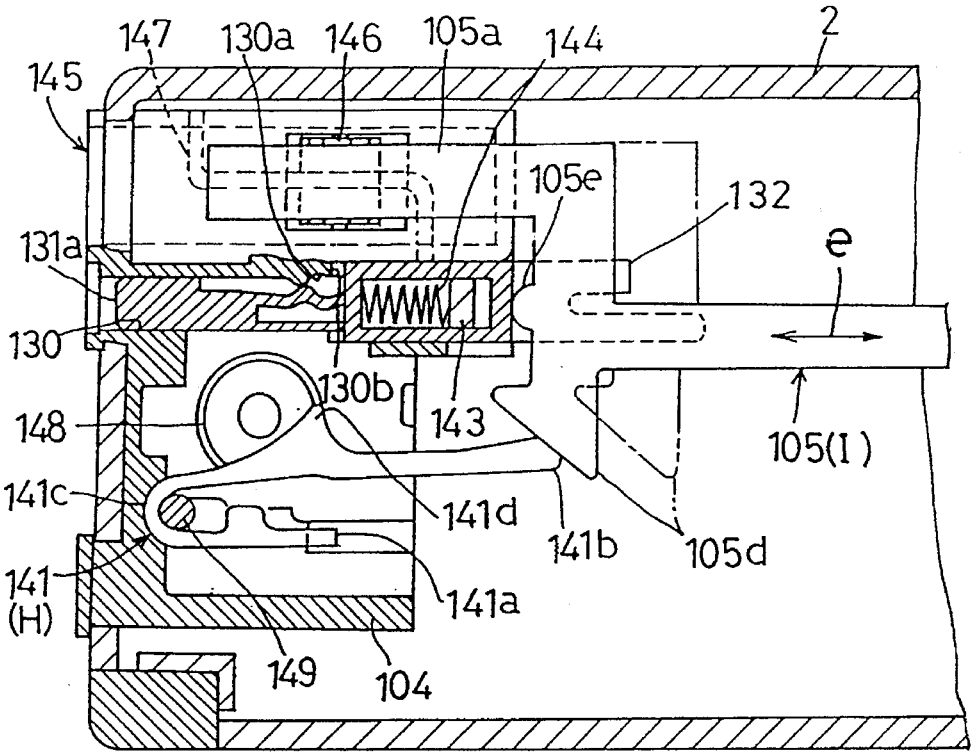
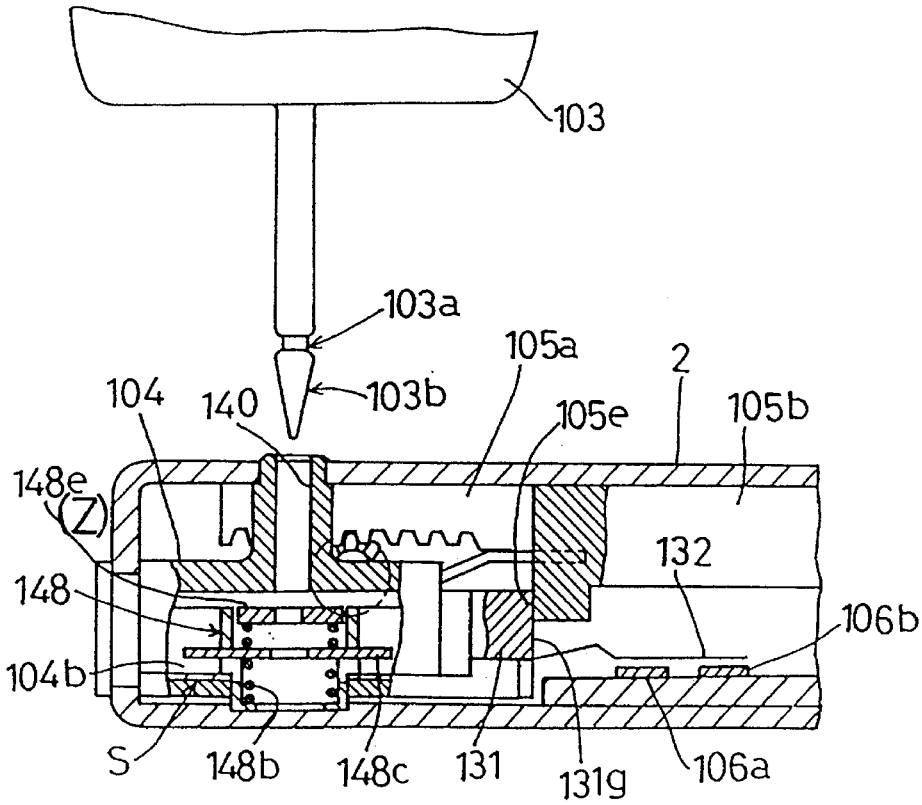
FIG. 21B.

THEFT PREVENTIVE APPARATUS HAVING AN ALARM OUTPUT DEVICE

TECHNICAL FIELD

The present invention relates to theft preventive apparatus, and particularly to a theft preventive apparatus comprising an attached state detecting device exposed outside a box for detecting a state of attachment to an object of theft prevention, the box containing an alarm output device for detecting detachment of the box from the object of theft prevention based on information from the attached state detecting device, and outputting an alarm upon detection of the detachment, and a battery for driving the alarm output device.

BACKGROUND ART

Such a theft preventive apparatus is used as attached to an object of theft prevention such as a commodity displayed in a shop, for example, and outputs an alarm when the theft preventive apparatus is unlawfully detached from the object of theft prevention, i.e. when the theft preventive apparatus, with the alarm output device in operative state, is forcibly detached from the theft preventive apparatus.

There are various types of attached state detecting devices used according to forms of object of theft preventions to which the theft preventive apparatus are attached. For example, one type has a switch provided on a box to be retractable through contact with an object of theft prevention. A wire-like member may be connected to a box to act also as a element for attachment to an object of theft prevention to be wound around the object of theft prevention. A pin-like member may be used to extend into an object of theft prevention to hold it with a box.

In the ease of the above-mentioned attached state detecting device comprising a switch, the on/off state of the switch changes when the box of the theft preventive device is forcibly detached from the object of theft prevention. In the ease of the wire-like or pin-like attached state detecting device, the box is detached from the object of theft prevention by cutting the wire-like attached state detecting device or pulling out the pin-like attached state detecting device, bring about a change of state.

The alarm output device outputs an alarm based on information on the change of state of the attached state detecting device. Generally, the theft prevention device itself has a buzzer for sounding an alarm, or outputs an electric wave signal as the output of alarm, which electric wave signal is received to give an alarm sound.

A power source for driving the alarm output device in a box, generally, comprises an alarm output device driving battery mounted in the box in order to achieve compactness of the theft prevention device as a whole.

It is therefore necessary for the box to have also a built-in device for turning on and off the power supply the battery to the alarm output device.

A construction conventionally conceived as means for turning the power supply on and off is such that the supply is turned on and off based on whether or not to connect electrode terminals for contacting opposite poles of the battery.

With such a construction, however, the battery could move, by vibration during transport of the theft preventive apparatus, into contact with the electrode terminals, whereby power is supplied to the alarm output device to start its operation and consume the power of the battery. Furthermore, depending on a state of the attached state detecting device, the attached state detecting device may output an alarm. Thus, improvement has been desired.

The present invention has been made having regard to the state of the art noted above, and its object is to provide a theft preventive apparatus in which, in a condition not intended for use, does not start operating inadvertently by vibration or the like.

DISCLOSURE OF THE INVENTION

A theft preventive apparatus according to the present invention comprises an attached state detecting device exposed outside a box for detecting a state of attachment to an object of theft prevention, alarm output means mounted in said box for detecting removal of said box from the object of theft prevention based on information from said attached state detecting device, and outputting an alarm in time of detection of the removal, a battery mounted in said box for driving said alarm output means, and a power supply switch for turning power supply on and off between said battery and said alarm output means.

With this construction, when the theft preventive apparatus is out of use, the power supply switch is turned off to stop power supply to the alarm output means inside the box. When using the theft preventive apparatus, the power supply switch is turned on after attaching the box of the theft preventive apparatus to an object of theft prevention, to supply power to the alarm output means in the box to start operation of the theft preventive apparatus.

When, with the theft preventive apparatus in operation, the box of the theft preventive apparatus is detached from the object of theft prevention in an improper way, the state of the attached state detecting device changes, and the alarm output means outputs an alarm based on information from the attached state detecting device.

In time of transport such as shipment of the theft preventive apparatus, the power supply switch is turned off to stop power supply from the battery to the alarm output means. Then, even if the theft preventive apparatus vibrates during transport, power is not supplied from the battery in the alarm output means to start operation of the theft preventive apparatus.

Besides, when the theft preventive apparatus out of use should be dropped inadvertently, power is not supplied from the battery in the alarm output means to start operation of the theft preventive apparatus either.

Consequently, the power of the battery is not wasted, and naturally an alarm is not outputted in error. Thus, the theft preventive apparatus has improved reliability.

The power supply switch may have an operated portion indented from a surface of the box.

According to this construction, the operated portion of the power supply switch is indented from the surface of the box, and even if a corner of a foreign object contacts to the position of the box where the operated portion of the power supply located, the power supply switch has little chance of being actuated inadvertently.

Consequently, since the power supply switch is little likely to be actuated through contact with a foreign object, an operation is hardly needed to stop the theft preventive apparatus operated in error. The theft preventive apparatus is convenient in that the trouble of management of the theft preventive apparatus is reduced.

Further, the attached state detecting device may comprise a mounting member connected to the box, the power supply switch being changeable from off state to on state when the mounting member is connected to the box.

According to this construction, the theft preventive apparatus normally is attached to an object of theft prevention through the mounting member connected to the box. When attaching the theft preventive apparatus to the object of theft prevention with the mounting member, the power supply switch changes from off state to on state upon connection of the mounting member to the box.

That is, only by connecting the mounting member to the box to attach the box to the object of theft prevention, the operation of the theft preventive apparatus is started simultaneously.

Consequently, only by connecting the mounting member to the box to attach the box to the object of theft prevention, the operation of the theft preventive apparatus is started simultaneously. Thus, the theft preventive apparatus needs a simplified control, which makes the theft preventive apparatus still more convenient.

Further, the box may contain a turn-off member for turning off the power supply switch, and a pinion gear meshed with a rack portion of the turn-off member, the pinion gear being rotatable by a control member having rack portions at opposite ends thereof, to turn off the power supply switch.

According to this construction, the rack portion at the end of the control member is inserted into the box to rotate the pinion gear provided in the box. This changes the power supply switch from on state to off state.

That is, the box contains the pinion gear which is an object of control by the control member to turn off the power supply switch. While the power supply switch cannot be turned off without the special control member, the use of the control member allows the power supply switch to be turned off simply by inserting the control member into the box.

Consequently, while the power supply switch cannot be turned off easily from outside the box, the use of the control member for turning off the power supply switch allows the power supply switch to be turned off simply by inserting the control member into the box. Thus, operation is simplified while maintaining the high degree of reliability of theft preventive apparatus, which makes the theft preventive apparatus still more convenient.

Further, the box may include lock means for preventing separation of the box and the mounting member, and lock release means for canceling separation preventive action of the lock means, the lock release means being operable with an operation of the control member to turn off the power supply switch.

According to this construction, when the mounting member is connected to the box to attach the theft preventive apparatus to the object of theft prevention with the mounting member, the lock means provided in the box prevents separation of the box and mounting member, so that the box remains attached to the object of theft prevention.

For detaching the box of the theft preventive apparatus from the object of theft prevention, the rack portion at the end of the control member is inserted into the box to rotate the pinion gear provided in the box. This changes the power supply switch from on state to off state, and cancels the separation preventive action of the lock means, to render the box and mounting member separable.

That is, only by inserting the rack portion at the end of the control member, the power supply switch is turned off, and allows separation of the box and mounting member, i.e. allows the box of the theft preventive apparatus to be detached from the object of theft prevention.

Consequently, the theft preventive apparatus needs a simplified control, which makes the theft preventive apparatus still more convenient.

Further, the alarm output means may output an alarm with an operation of the control member to turn off the power supply switch.

According to this construction, the alarm output means outputs an alarm with an operation of the control member to turn off the power supply switch.

This enables a confirmation whether the battery is in a condition for use or not, without requiring a special operation.

Consequently, the theft preventive apparatus needs a simplified control, which makes the theft preventive apparatus still more convenient.

Further, the attached state detecting device may include connectors arranged at opposite ends thereof for insertion into and removal from the box, the connectors having engageable portions, the box including engaging members biased toward engaging positions for engaging the engageable portions, the box including a lock release means for canceling engagement between the engageable portions and the engaging members.

According to this construction, the connectors at the opposite ends of the mounting member are inserted into the box after the mounting member is engaged with the object of theft prevention. When the connectors are inserted into the box, the engaging members in the box biased toward the engaging positions to engage the engageable portions to retain the connectors. With the box and mounting member connected together, the theft preventive apparatus can be attached to the object of theft prevention reliably.

With the theft preventive apparatus attached in this way, if the box and mounting member are disconnected in a dishonest attempt to remove the theft preventive apparatus, the alarm output means detects it and outputs an alarm.

On the other hand, for changing the mounting member, the lock release means is used to cancel the engagement between the engaging members in the box and the engageable portions of the mounting member. Then, the mounting member is detached from the box, and a new mounting member is set in place.

That is, the mounting member may be changed, leaving the engaging members in the box as biased toward the engaging positions to engage the engageable portions to retain the connectors of the mounting member inserted into the box.

Consequently, the manufacturing cost of the mounting member is reduced to produce a desirable effect reducing the maintenance cost of the theft preventive apparatus.

The present invention may be modified to further comprise push-out means for pushing out the connectors in a direction opposite to a direction of insertion, with an operation of the lock release means for disengaging the engageable portions and the engaging members.

According to this construction, when the engagement between the engaging members in the box and the engageable portions of the mounting member is canceled with the lock release means, the pushout means pushes the connectors in the direction opposite to the direction of insertion.

This prevents the engaging members and engageable portions once disengaged from each other from engaging again under the biasing force acting on the engaging members in the direction of engagement.

Consequently, the connectors are pushed out without allowing the engaging members and engageable portions once disengaged to engage again. This allows the unlocked mounting member to be detached from the box easily, which produces a desirable effect of simplifying the operation of the theft preventive apparatus.

Further, the attached state detecting device may include a shank insertable into the box, the box housing switch means for controlling power supply to the alarm output means such that the alarm output means is placed in an output halt state when the shank is inserted into the box, and the alarm output means is placed in an outputting state when the shank is removed from the box, the switch means having a contact opening and closing conductive operated portion pushed when the shank is inserted into the box to place the alarm output means in the output halt state, and biased toward an outputting position to place the alarm output means in the outputting state, insulating means being provided for electrically insulating the operated portion and the shank.

According to this construction, when the shank of the mounting member is inserted into the box, the conductive operated portion is pushed to place the alarm output means in the output halt state. This state is a state in which the theft preventive apparatus is attached to the object of theft prevention. The alarm output means stops the output, and no alarm is given.

Next, when the shank is forcibly detached from the box, the conductive operated portion, under the return biasing force, places the alarm output means in the outputting state. The alarm output means in the outputting state outputs an alarm to notify that the theft preventive apparatus has been detached falsely.

The operated portion acting as the switch means as above is pushed when the shank of the mounting member is inserted into the box. Since the operated portion and the shank are electrically insulated by the insulating means, when the shank contacts a foreign object charged with static electricity, the static electricity is not transmitted to the operated portion.

Consequently, the electric circuits in the box are protected from the influence of static electricity. Thus, the theft preventive apparatus prevents external static electricity from damaging the electric circuits in the box.

Further, the insulating means may include an insulator pushed by the shank inserted into the box, and elastic means disposed between the insulator and the operated portion for pushing the operated portion to the halt state when the insulator is pushed by the shank, and for allowing the insulator to move toward the operated portion after the operated portion is moved to the halt state.

According to this construction, when the of the mounting member is inserted into the box, the insulator is pushed by the shank. The movement of the insulator is transmitted to the operated portion through the elastic means such as a spring, whereby the operated portion is pushed.

The operated portion is pushed to assume the halt control state. After the operated portion assumes the halt state, the elastic means still permits the insulator to move toward the operated portion.

Thus, the insulator is maintained in a position slightly closer to the operated portion than a position thereof when the operated portion assumes the halt state. The operated portion can be maintained in the halt state reliably even if the shank should shift slightly in the direction of insertion.

Consequently, the theft preventive apparatus is operable steadily, to promote the reliability of the theft preventive apparatus still further.

Further, the attached state detecting device may include a head having an outer configuration to promote a turnover the attached state detecting device stood on the head, the attached state detecting device having a center of gravity balance to promote a turnover of the attached state detecting device stood on the head.

According to this construction, when the attached state detecting device is removed from the box and placed in a certain location, the attached state detecting device, even when stood on the head, will turn over owing to the outer configuration of the head and the center of gravity balance of the attached state detecting device. Thus, the tip end of the shank will never be pointed upward.

Consequently, the operator need not pay much attention to the tip end of the shank of the attached state detecting device. This renders the theft preventive apparatus easy to handle.

Further, the head of the attached state detecting device may be formed of plastic, with a metal plate mounted inside the head or on an end surface thereof opposed to the shank to cross an axis of the shank.

According to this construction, when, in an attempt to remove the attached state detecting device from the box falsely, a nipper or the like is used to cut the head of the attached state detecting device longitudinally of the shank and then circumferentially of the shank, the metal plate provided for the head of the attached state detecting device checks the cutting even if the plastic part of the head may be cut.

Consequently, an act of attempting to remove the attached state detecting device from the box falsely is effectively prevented while the head of the attached state detecting device is formed of plastic for an excellent mass production feature. Thus, the theft preventive apparatus has a still improved reliability.

Preferably, the alarm output means of the present invention includes an alarm sound output means for outputting an alarm sound, the box including receiver means for receiving a medium of information communication transmitted from a transmitter installed in a particular location, the alarm sound output means outputting the alarm sound based on detection information from the receiver means, the alarm sound output means being constructed not to transmit the medium of information communication transmitted from the transmitter.

With this construction, when the alarm sound output means operates to sound the alarm, it does not send the same medium as the medium for information communication transmitted from the transmitter installed in a predetermined location. Thus, even where theft prevention apparatus are disposed close to one another, the operation of the alarm sound output means does not cause malfunctioning of the receiver means of the other theft prevention apparatus.

Consequently, since the operation of the alarm sound output means does not cause malfunctioning of the receiver means of the other theft preventive apparatus, malfunctioning of the theft preventive apparatus is avoided to promote reliability of the theft preventive apparatus.

Further, the alarm sound output means may comprise a piezoelectric buzzer.

With this construction, since a piezoelectric buzzer is used as the alarm sound output means, the alarm sound output means may be formed thin and lightweight.

Consequently, since the alarm sound output means is formed thin and lightweight, the theft preventive apparatus may be formed thin and lightweight.

Further, the box may have a battery (button type or coin type) for supplying power to the alarm sound output means and the alarm sound output means opposed to each other therein, and a plate-like terminal unit having a terminal connected to an electrode of the battery and a terminal connected to an electrode of the alarm sound output means being disposed between the battery and the alarm sound output means.

According to this construction, the battery (button type or coin type) and piezoelectric buzzer are opposed to each other, and a plate-like terminal unit having a terminal connected to an electrode of the battery and a terminal connected to an electrode of the piezoelectric buzzer is provided between the battery and piezoelectric buzzer. Thus, three types of flat components (battery, piezoelectric buzzer and terminal assembly) are arranged in superposition within the box.

Consequently, the theft preventive apparatus may be formed very thin.

Further, the alarm sound output means may output an intermittent sound as alarm sound.

This construction facilitates recognition of the alarm sound of the theft preventive apparatus, and reduces power consumption of the theft preventive apparatus, thereby promoting efficiency of the theft preventive apparatus.

Consequently, shop assistants and the like recognizes the alarm sound with ease. Power consumption of the theft preventive apparatus is less than where the alarm sound is outputted any time.

The box may have sound release openings formed in a side surface thereof for releasing the alarm sound outputted from the alarm sound output means outside said box.

With this construction, the alarm sound outputted from the alarm sound output means is released through the openings in the side surface of the box. The alarm sound release openings are difficult to block up, compared with the case where such openings are formed in a front surface or bottom surface of the box. That is, when the theft preventive apparatus is formed thin, the side surfaces of the box have a smaller width than the front surface and bottom surface. If the openings were formed in the front surface or bottom surface of the box, it would be possible to block up the openings easily with fingers or the like (such an act is taken to stifle the alarm sound). However, the openings are difficult to block up by providing the openings in the side surface of the box.

Consequently, it is now possible to prevent effectively a preliminary stealing act to take the object of theft prevention outside the shop, with fingers blocking up the openings to suppress the alarm sound.

The box may have a shield wall mounted therein for shielding components in the box against exposure through the openings.

With this construction, since the shield wall is provided to shield components in the box against exposure through the openings, the shield can bar entry of a foreign object inserted through an opening into the box. The alarm sound generated in the box is guided round the shield wall to the openings to be released outside the box.

Consequently, it is now possible to prevent effectively a preliminary stealing act to destroy the components in the box by inserting a foreign object through an opening.

Further, the present invention may be modified such that the receiver means comprises a resonance antenna for a theft preventive apparatus for outputting a signal to operate the alarm means upon receipt of the electric wave from the transmitter, and has a coil, a capacitor and a resistor in parallel connection.

With this construction, the resistor is connected in parallel to the coil and capacitor already in parallel connection. This resonance antenna has what is known as Q-value of a resonator lowered, whereby the resonance antenna has a reduced frequency selectivity. Thus, the reception sensitivity of the resonance antenna is little variable with variations in resonance frequency due to variations in circuit constant caused by variations in the coil and capacitor.

With this construction, therefore, the reception sensitivity of the resonance antenna is little variable with variations in resonance frequency. This minimizes variations in reception sensitivity occurring with different resonance antennas, thereby to promote yield in the manufacture of resonance antennas for use in theft preventive apparatus.

BRIEF DESCRIPTION OF THE DRAWINGS

FIG. 10 is an enlarged view of a lock release key for use with the embodiment of FIG. 1, FIG. 11 is a sectional view of a principal portion of the embodiment of FIG. 1, FIGS. 12(*a*) and 12(*b*) are enlarged views of a slider in the embodiment of FIG. 1.

BEST MODE FOR CARRYING OUT THE INVENTION

An embodiment of the present invention will be described hereinafter with reference to the drawings.

Figure 2A:
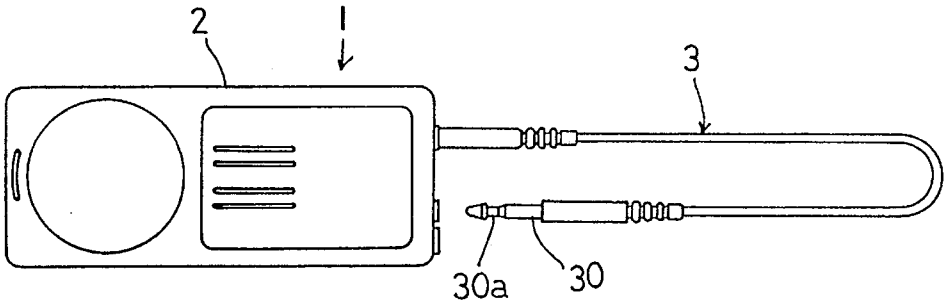
Figure 2B:
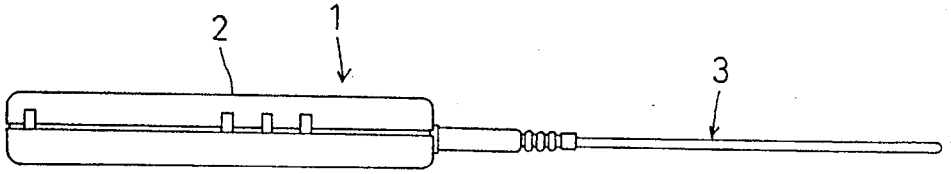

As shown in the plan view of FIG. 2(*a*) and the side view of FIG. 2(*b*), a sensor tag 1 acting as a theft preventive apparatus includes a rectangular parallelopiped box 2 and a wire unit 3 acting as an attaching device for attaching the box 2 to an object of theft prevention such as a commodity or the like.

Figure 3:
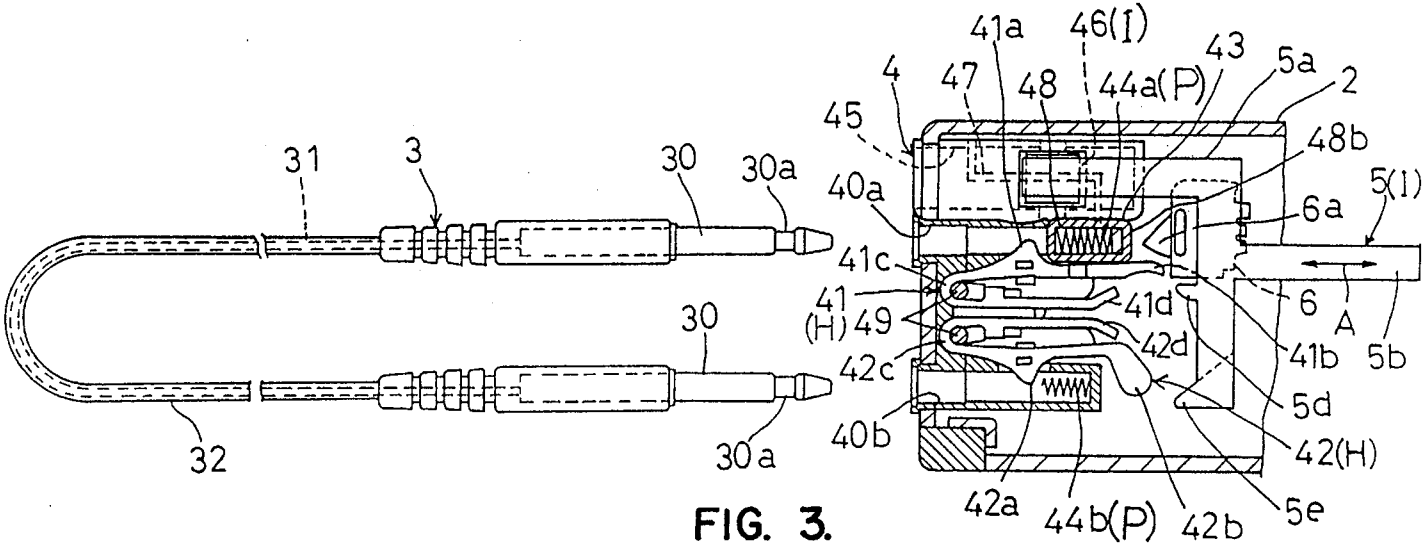
FIG. 3 is a sectional view of a principal portion of the embodiment of FIG. 1.

As shown in FIG. 3, the wire unit 3 has lock pins 30 disposed at opposite ends for connection to the box 2, a wire 31 interconnecting the lock pins 30, and a sheath 32 covering the wire 31 and parts of lock pins 30.

Figure 5:
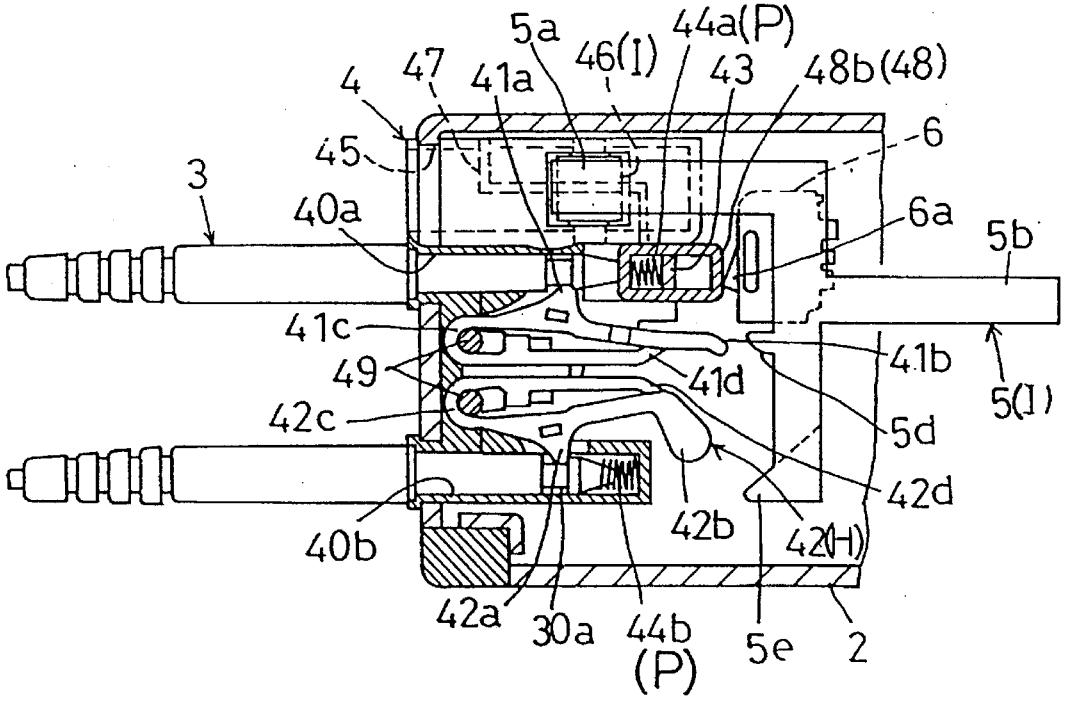
FIG. 5 is a sectional view of the principal portion of the embodiment of FIG. 1.
Figure 6:
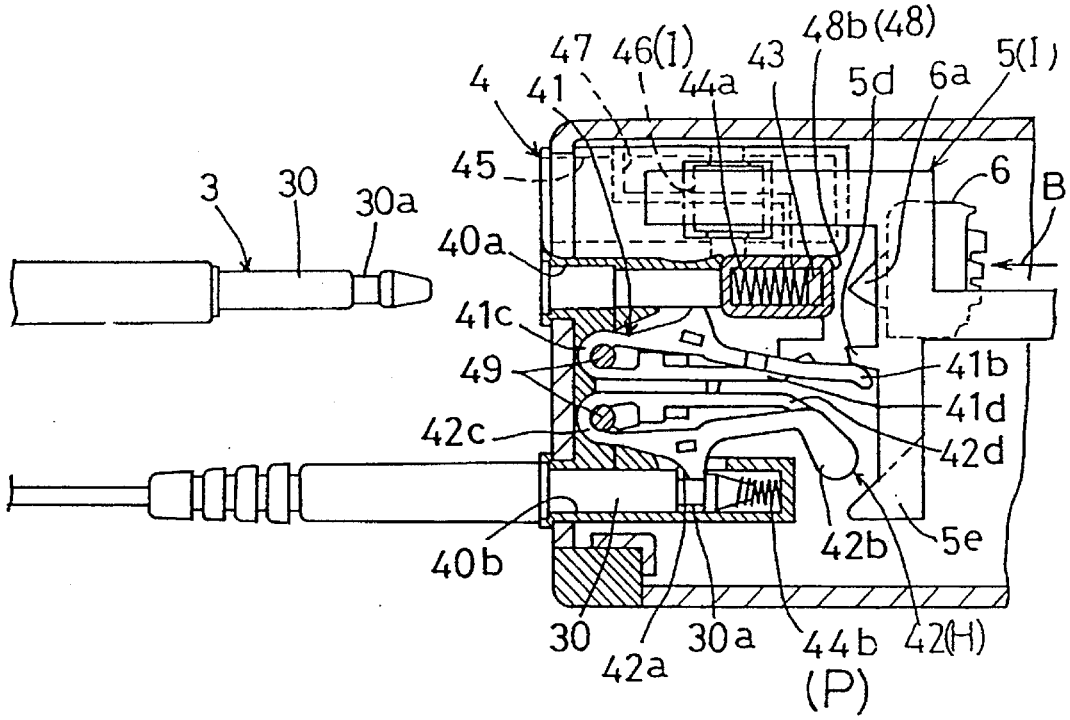
FIG. 6 is a sectional view of the principal portion of the embodiment of FIG. 1.

The lock pins 30 and wire 31 are formed of metal, and are conductive. The lock pins 30 at the opposite ends are electrically interconnected. The lock pins 30 have engaging grooves 30*a* formed adjacent tip ends thereof for retaining the lock pins 30 in the box 2. As shown in FIG. 3, slight shoulders are formed at ends of the sheath 32 covering the lock pins 30. When lock pins 30 are inserted into the box 2, the shoulders extend into the box 2, as shown in FIG. 5, so that the lock pins 30 are not exposed to the outside. This prevents the lock pins 30 from contacting other objects charged with static electricity, which would damage electric circuits in the box 2.

Figure 1:
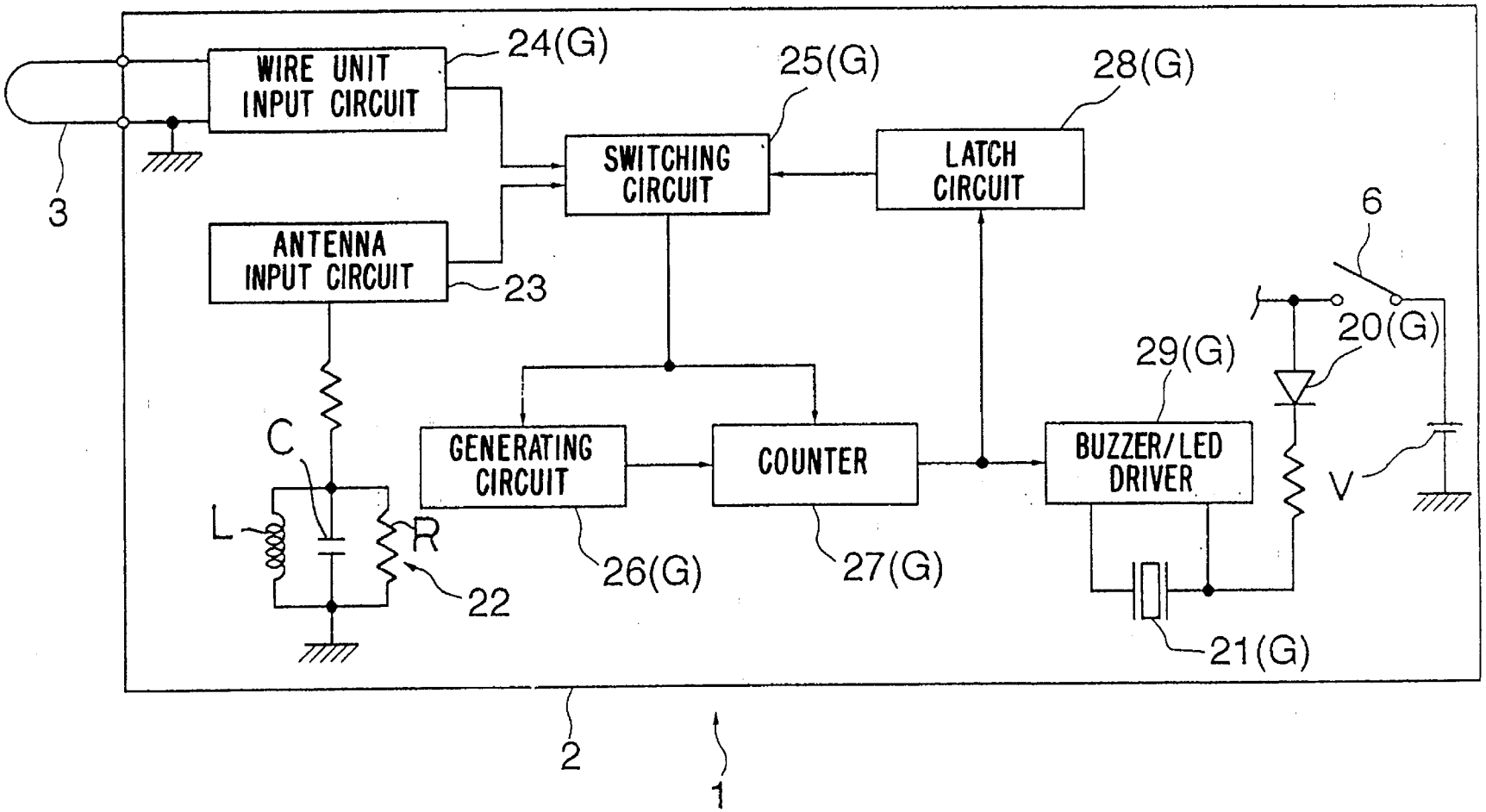
FIG. 1 is a schematic view of a theft prevention device in an embodiment of the present invention, FIGS. 2(*a*) , (*b*) are views showing outward appearances of the embodiment of FIG. 1.

As shown in FIG. 1, the box 2 contains an LED lamp 20; a piezoelectric buzzer 21; a resonance antenna 22 including a coil L, a capacitor C and a resistor R; an antenna input circuit 23 for outputting a reception signal when the resonance antenna 22 is in signal receiving state; a wire unit input circuit 24 for outputting a wire cutoff signal when the wire unit 3 is not properly connected; a switching circuit 25 for outputting a control signal upon receipt of the reception signal from the antenna input circuit 23 or wire cutoff signal from the wire unit input circuit 24; a generating circuit 26 which starts generating pulses upon input of the control signal from the switching circuit 25; a counter 27 which starts counting the pulses generated by the generating circuit 26 upon input of the control signal from the switching circuit 25, and outputs a count completion signal when the count exceeds a predetermined number; a latch circuit 28 responsive to input of the count completion signal to maintain switching circuit 25 in the state of receiving the above reception signal or wire cutoff signal; a buzzer/LED driver 29 lighting the LED lamp 20 and sounding the piezoelectric buzzer 21 upon input of the count completion signal of counter 27; a battery V for supplying power to the respective circuits in the box 2; and a power supply switch 6 for turning on and off the power supply from the battery V to the circuits.

Figure 8:
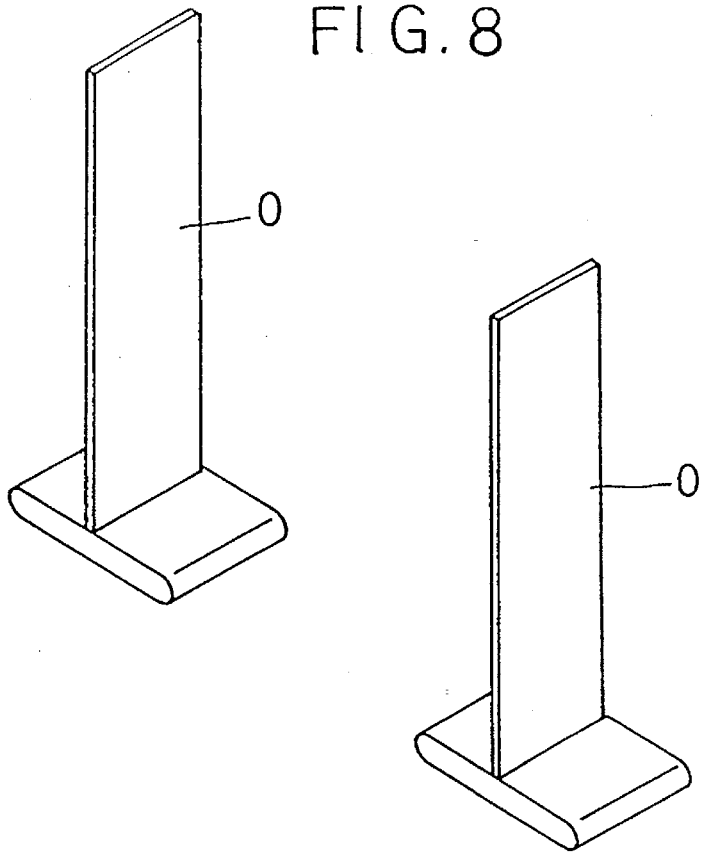
FIG. 8 is a perspective view of an outward appearance of a transmitter in the embodiment of FIG. 1.

In the circuit having the above construction, the piezoelectric buzzer 21 mounted in the box 2 sounds to output an alarm when, with the power supply switch 6 turned on and the box 2 is attached through the wire unit 3 to an object of theft prevention such as a commodity, the wire unit 3 is cut, or the sensor tag 1 is passed through a position where a pair of panel-like transmitters O as shown in FIG. 8 are installed at opposite sides of an entrance of a shop. One of the panel-like transmitters O may be installed at one side of the entrance, or on a floor of the entrance.

Thus, the wire unit 3 acts as an attached state detecting member for detecting a state of attachment to an object of theft prevention. Of the circuits mounted in the box 2, the LED lamp 20, piezoelectric buzzer 21, wire unit input circuit 24, switching circuit 25, generating circuit 26, counter 27, latch circuit 28 and buzzer/LED driver 29 act as an alarm output device G for outputting an alarm based on information from the wire unit 3.

A process for causing the piezoelectric buzzer 21 to begin to sound will be described briefly hereinafter.

The current flowing through the wire unit 3 is stopped when the wire unit 3 and box 2 are disconnected such as when the wire unit 3 is cut. The wire unit input circuit 24 detects this state.

Upon detection of the de-electrification of wire unit 3, the wire unit input circuit 24 outputs the wire cutoff signal to the switching circuit 25.

While the wire cutoff signal is inputted, the switching circuit 25 sends the control signal to the generating circuit 26 and counter 27. While the control signal is received, the generating circuit 26 generates pulses, and the counter 27 counts the pulses generated by the generating circuit 26. When the control signal stops, the generating circuit 26 stops generating pulses, and the counter 27 stops counting and resets a pulse count.

Each time a predetermined count of pulses is reached, the counter 27 sends one pulse signal as a count completion signal to the latch circuit 28 and buzzer/LED driver 29.

While this count completion signal is received, the buzzer/LED driver 29 sounds the piezoelectric buzzer 21, and flashes the LED lamp 20.

On the other hand, the latch circuit 28 receives the count completion signal from the counter 27, and maintains the switching circuit 25 in the state of receiving the above wire cutoff signal. The switching circuit 25 thereby continues sending the control signal to the generating circuit 26 and counter 27.

In other words, the buzzer/LED driver 29 sounds the piezoelectric buzzer 21 and lights the LED lamp 20 after the switching circuit 25 receives the wire cutoff signal and the counter 27 completes counting up to the predetermined count. Thus, unless the wire cutoff signal is continuously received over a fixed time, the piezoelectric buzzer 21 and LED lamp 20 remain out of operation. The prevents malfunctioning due to noise or the like.

The switching circuit 25 continues sending the control signal once the counter 27 outputs the count completion signal, regardless of presence or absence of the cutoff signal from the wire unit input circuit 24. As a result, until the power supply switch 6 is turned off, the piezoelectric buzzer 21 continues outputting intermittent sound synchronously with the count completion signal from the counter 27, and the LED lamp 20 continues flashing synchronously with the count completion signal from the counter 27.

When the sensor tag 1 passes through a position where the transmitters O are installed, the resonance antenna 22 generates an electromotive force with an electric wave from the transmitters O. The antenna input circuit 23 detects the electromotive force, and outputs the reception signal to the switching circuit 25.

Thus, the resonance antenna 22 acts as a reception device for receiving a medium (electric wave) of information communication sent from the transmitters installed in a particular location. The piezoelectric buzzer 21 acts as an alarm sound output device to output an alarm sound based on reception information of the reception device (resonance antenna 22), but not to transit the medium (electric wave) of information communication sent from the transmitters O installed in the particular location.

The resonance antenna 22 has its reception sensitivity adjusted beforehand according to an expected spacing with which the pair of transmitters O are installed.

The adjustment of reception sensitivity can be carried out in two ways.

The reception sensitivity of resonance antenna 22 increases linearly with an increase in the resistance value of resistor R. Accordingly, one of the two methods is carried out by appropriately changing the resistor R to one having a suitable resistance value. When the resistance value of the resistor is changed, Q value of the resonance antenna changes with the resistance value, and the reception sensitivity of the resonance antenna changes with it.

On the other hand, the resonance frequency of the resonance antenna does not change even if the resistance value of the resistor is changed. Thus, the change of reception sensitivity by a change of resonance frequency need not be taken into account.

In adjusting the reception sensitivity of the resonance antenna according to this method, it is unnecessary to consider a change in reception sensitivity due to a change in resonance frequency. The reception sensitivity of the resonance antenna can, therefore, be adjusted easily.

Figure 13:
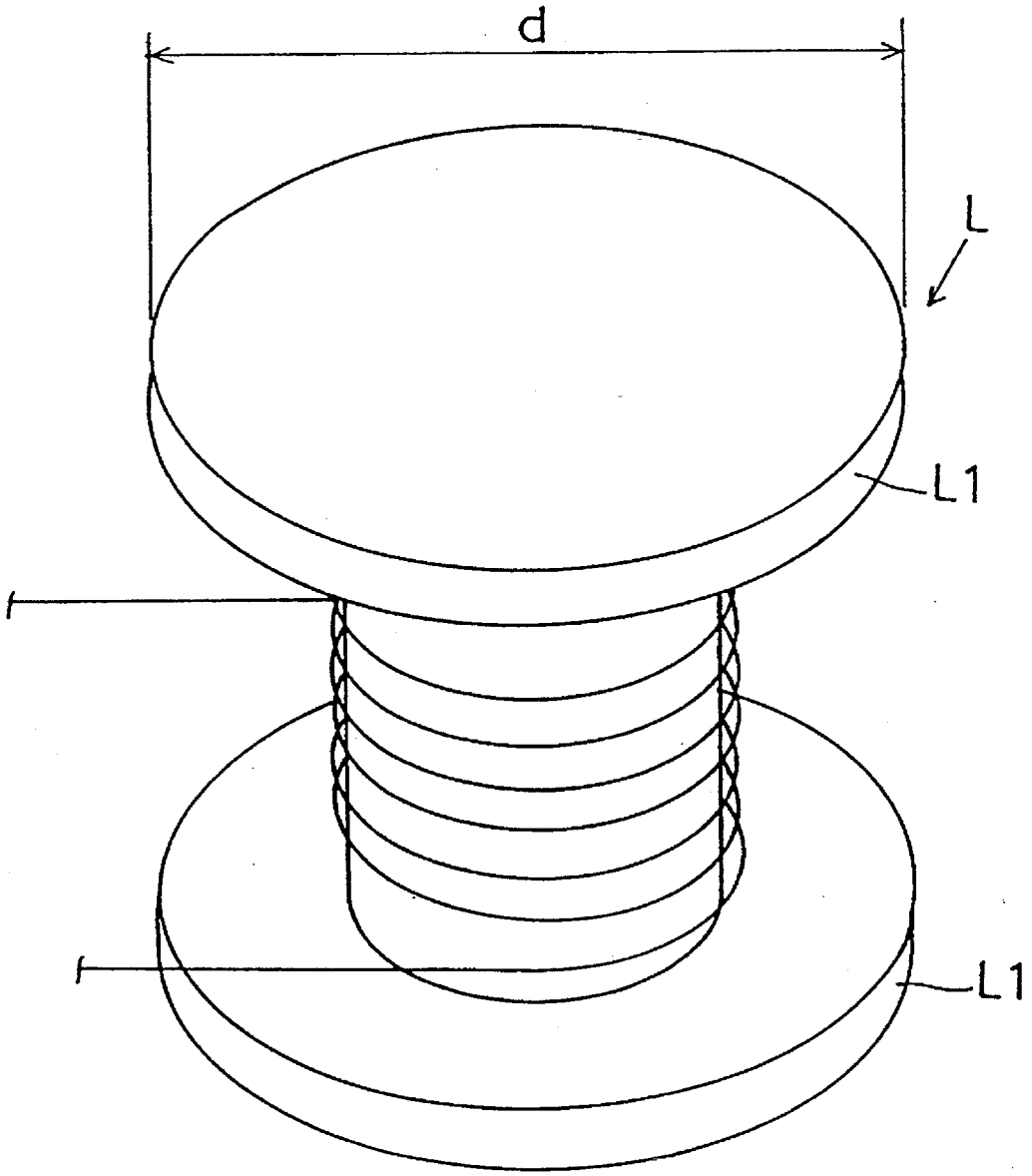
FIG. 13 is an enlarged view of a coil in the embodiment of FIG. 1, FIGS. 14(*a*), (*b*), (*c*) are views showing outward appearances of another embodiment of the present invention.

The coil L has a drum type core L1 as shown in FIG. 13. The reception sensitivity of resonance antenna 22 increases linearly with an increase in flange diameter d of drum type core L1. The other method is carried out by using a core having a suitable flange diameter d. Even if flange diameter d is changed, the inductance of coil L should be maintained substantially fixed. When the flange diameter of the drum type core of the coil is varied, the convergence effect of magnetic flux by the coil changes, which in turn changes the reception sensitivity of the resonance antenna. On the other hand, the resonance frequency of the resonance antenna does not change with a change in the above flange diameter if the inductance value of the coil is fixed. Accordingly, a change in reception sensitivity due to a change in resonance frequency need not be considered.

Thus, in adjusting the reception sensitivity of the resonance antenna according to this method, a change in reception sensitivity due to a change in resonance frequency need not be considered. The reception sensitivity of the resonance antenna can be adjusted easily.

The operation of each circuit after the switching circuit 25 receives the reception signal is the same as when the wire unit 3 is cut, and will not be described again.

A construction for attaching the wire unit 3 to the box 2 will be described next.

As shown in FIGS. 3–7, the wire unit 3 is attached to the box 2, with the lock pins 30 of wire unit 3 inserted into two lock pin insertion bores 40*a*, 40*b* of a jack unit 4 contacting an inner wall of box 2.

The jack unit 4 has, arranged in juxtaposition, an approximately U-shaped lock spring 41 for engaging and retaining the lock pin 30 inserted into the lock pin insertion bore 40*a*, and an approximately U-shaped lock spring 42 for engaging and retaining the lock pin 30 inserted into the lock pin insertion bore 40*b*. The two lock springs 41, 42 act as lock means H for checking detachment of the wire unit 3.

At an end inwardly of the box 2 of the lock pin insertion bore 40*a* extending through the jack unit 4, a set lever 48 is provided to be slidable in the lock pin insertion bore 40*a* in directions of insertion and removal of lock pin 30.

The lock springs 41, 42 are engaged at curved portions 41*c*, 42*c* thereof with engaging projections 49 projecting from a main body of jack unit 4. Ends 41*d*, 42*d* of locks springs 41, 42 lying adjacent each other in inward positions are fixed to a circuit board rigidly supporting the circuits shown in FIG. 1.

Bulges 41*a*, 42*a* are formed in intermediate positions between the other ends 41*b*, 42*b* and curved portions 41*c*, 42*c* of lock springs 41, 42 to be projectable and retractable to engage the engaging grooves 30*a* of lock pins 30.

The lock springs 41, 42 are formed of metal and are conductive for electrically connecting the lock pins 30 to the above-mentioned circuit board.

Lock springs 41, 42 am approximately U-shaped, and, therefore, have elasticity in directions to move the opposite ends thereof toward and away from each other. When no force is applied to the lock springs 41, 42, as shown in FIG. 3, the bulges 41*a*, 42*a* project almost to the central positions in the pin insertion bores 40*a*, 40*b*.

Thus, the engaging grooves 30*a* of lock pins 30 and the bulges 41*a*, 42*a* engage each other, the bulges 41*a*, 42*a* are pushed in the direction to retract from the lock pin insertion bores 40*a*, 40*b*, whereby the lock springs 41, 42 are biased toward engagement with the lock pins 30.

Figure 9:
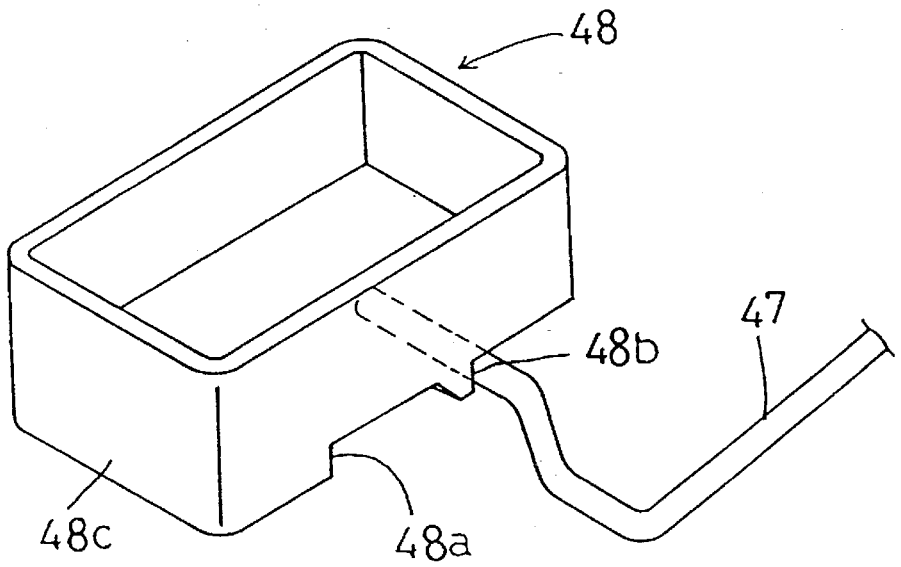
FIG. 9 is a perspective view of a set lever in the embodiment of FIG. 1.

As shown in FIG. 9, the set lever 48 is in the form of a box having an open side. A projection 43 projects from an inner wall of lock pin insertion bore 40*a* into a space defined by this set lever 48 and inner wall of lock pin insertion bore 40*a*. Two engaging portion 48*a*, 48*b* are arranged, in sliding directions of set lever 48, on a bottom of box-like set lever 48 to engage a tip end portion of a movement check spring 47 described later.

A coil spring 44*a* is mounted between the projection 43 and inner wall of set lever 48, to bias the set lever 48 back toward an inlet of lock pin insertion bore 40*a*.

The other lock pin insertion bore 40*b* is closed at a deep end thereof. A coil spring 44*b* is mounted in the lock pin insertion bore 40*b*, with one end thereof fixed to the deep end.

A key insertion bore 45 is formed in a position of lock pin insertion bore 40*a* remote from the lock pin insertion bore 40*b*, for receiving a lock release key K to release the lock pin 30 as described later.

As shown in FIG. 11, the key insertion bore 45 has, mounted therein, a pinion gear 46 rotatable by the lock release key K shown in FIG. 10, inserted into the key insertion bore 45, and the movement check spring 47 for checking movement of the set lever 48 provided for the lock pin insertion bore 40*a*. The lock release key K acts as a control member.

The pinion gear 46 is rotatably supported in the main body of jack unit 4, with teeth thereof projecting perpendicular to the direction of insertion of the lock release key, and partly projecting into the key insertion bore 45 and partly projecting outside the jack unit 4.

The pinion gear 46 is supported to be slightly movable in directions perpendicular to the sheet plane of FIGS. 3–7. When the lock release key K is absent from the key insertion bore 45, the pinion lies inwardly of the key insertion bore to be out of mesh with the rack 5*a* of slider 5.

The movement check spring 47 is formed of a thin metal piece to be elastically deformable. The movement check spring 47 has one end thereof fixed to one side adjacent an opening of the key insertion bore 45 to act as a proximal end, to be pivotable through elastic deformation. According to a position in the sliding direction of the set lever 48, the free end of the movement check spring 47 is pressed by the elastic action of movement check spring 47, to engage one of the engaging portions 48*a*, 48*b* of set lever 48. The biasing force of coil spring 44*a* prevents the set lever 48 from sliding in the direction of detachment of lock pin 30. FIG. 9 shows a state of engagement with the engaging portion 48*b*.

An intermediate portion between the proximal end and free end of movement check spring 47 extends across the key insertion bore 45.

The jack unit 4 includes a slider 5 mounted in a position thereof inwardly of the box 2, which acts as a control member, as shown in FIGS. 12(*a*) and 12(*b*), having a rack 5*a* meshed with the pinion gear 46 of jack unit 4 in the position shown in FIG. 11.

The slider 5 has a proximal portion 5*b* thereof slidably engaging a guide portion, not shown, formed on an inner wall of box 2, which is slidable in directions indicated by arrows A in FIG. 3, i.e. in the directions of insertion and removal of the lock release key K. A forward end of an elastically deformable extension 5*c* extending from an intermediate portion between rack 5*a* and proximal portion 5*b* engages the box 2, so that the elasticity of the extension 5*c* applies a biasing force inwardly of the box.

The slider 5 has, arranged in opposite positions across a connection between the rack 5*a* and proximal portion 5*b*, a first presser portion 5*d* for contacting the end 41*b* of lock spring 41, and a second presser portion 5*e* for contacting the end 42*b* of lock spring 42, with the sliding movement in the direction of arrow A of slider 5. A spacing between the end 42*b* of lock spring 42 and the second presser 5*e* is longer than a spacing between the end 41*b* of lock spring 41 and the first presser 5*d*.

For facility of illustration, the extension 5*c* of slider 5 is omitted from FIGS. 3–7.

The power supply switch 6 is disposed in a position of the lock pin insertion bore 40*a* of jack unit 4 inwardly of the box 2.

The power supply switch 6 is a normally off type switch. Switching is made from off state to on state when an operated portion 6*a* of power supply switch 6 is pushed by the set lever 48 of jack unit 4.

Engagement and disengagement between the wire unit 3 and box 2 will be described next.

Figure 4:
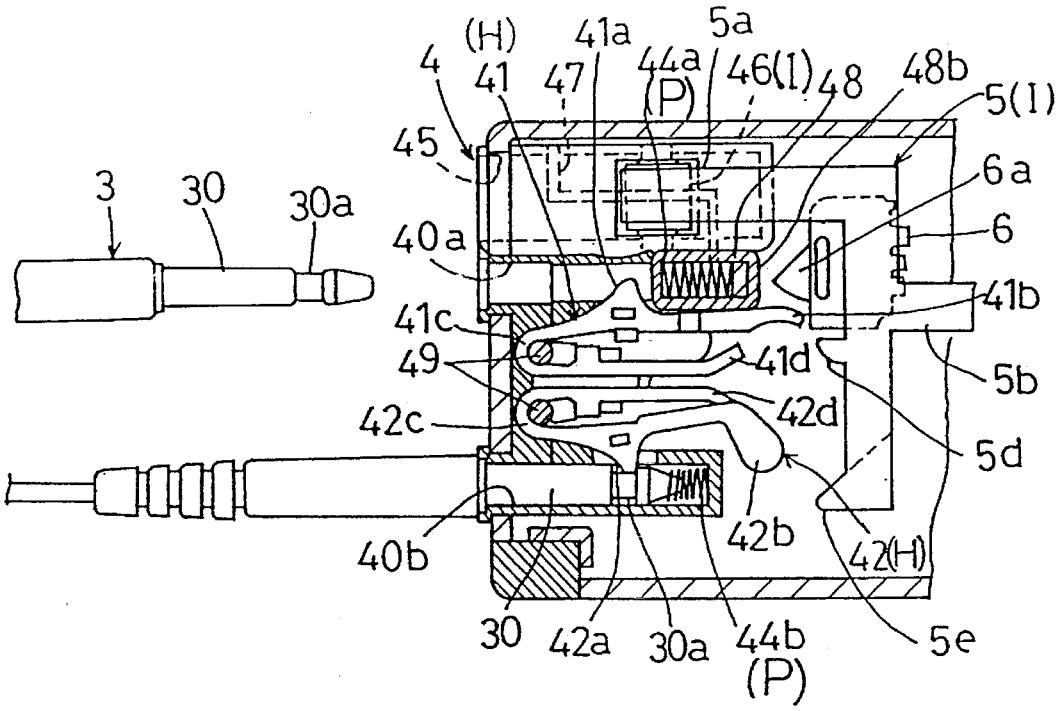
FIG. 4 is a sectional view of the principal portion of the embodiment of FIG. 1.

First, for engaging the wire unit 3 and box 2, in the state where both lock pins 30 of wire unit 3 are disengaged as shown in FIG. 3, one of the lock pins 30 is inserted into the lock pin insertion bore 40*b* of jack unit 4 as shown in FIG. 4. As the lock pin 30 is inserted against the biasing force of coil spring 44*b* provided for the lock pin insertion bore 40*b*, the bulge 42*a* of lock spring 42 projecting into the lock pin insertion bore 40*b* engages the engaging groove 30*a* of lock pin 30. The biasing force of coil spring 44*b* reliably prevents the lock pin 30 from moving in the direction of cancellation, to maintain the engaged state.

With one of the lock pins 30 inserted into the jack unit 4, the other lock pin 30 is placed in engagement with a commodity, and then inserted into the lock pin insertion bore 40*a* of jack unit 4.

As the lock pin 30 is inserted into the lock pin insertion bore 40*a*, the forward end of lock pin 30 contacts the set lever 48. As the lock pin 30 is further inserted while pushing the set lever 48, the bulge 41*a* of lock spring 41 projecting into in the lock pin insertion bore 40*a* engages the engaging groove 30*a* of lock pin 30 as shown in FIG. 5. This reliably prevents the lock pin 30 from moving in the direction of cancellation.

The pushing action of lock pin 30 applied to the set lever 48 causes the free end of movement check spring 47 engaged with the engaging portion 48*a* of set lever 48 to engage the engaging portion 48*b* of set lever 48 as shown in FIG. 9. As a result, the end of set lever 48 inwardly of the box 2 pushes the operated portion 6*a* of power supply switch 6 to start power supply to each circuit in the box 2 shown in FIG. 1.

As noted above, the wire unit 3 and the wire unit input circuit 24 in the box 2 are electrically interconnected through the engagement between the engaging grooves 30*a* of lock pins 30 and the bulges of lock springs 41, 42.

Next, the lock release key K shown in FIG. 10 is used for disengaging the wire unit 3 and jack unit 4 in the state shown in FIG. 5.

The lock release key K has a first rack portion K1 and a second rack portion K2 at opposite ends thereof for meshing with the pinion gear 46 of jack unit 4. These two rack portions K1, K2 are different in insertion depth for the key insertion bore 45 of jack unit 4. The lengths are set such that the insertion depth of the second rack portion K2 is slightly greater than the insertion depth of the first rack portion K1. Consequently, the pinion gear 46 is rotatable by different amounts when the first rack portion K1 is inserted into the key insertion bore 45 and when the second rack portion K2 is inserted into the key insertion bore 45.

The first rack portion K1 and second rack portion K2 differentiated in length in this way provide the following advantage.

The theft preventive apparatus needs to be removed from the object of theft prevention such as a commodity when the commodity is handed over to the purchaser in a proper selling act for that commodity. If the pair of connections of the wire unit are detached from the box at one time, the box could be dropped to the floor surface to be damaged. Normally, therefore, only one of the connection is detached. On the other hand, there may be an occasion requiring change of a damaged wire unit. In this case, it may be desirable to detach the two connections of the wire unit at a time. A selection between detachment of only one connection of the wire unit and detachment to be made at a time, may be made by the amount of insertion to the box of the lock release key K. In this case, the amount of insertion into the box of the lock release key may be determined by selected K1 or K2 without relying on the feel of the user.

As shown in FIG. 11, when the first rack portion K1 of the smaller insertion depth is inserted into the key insertion bore 45, the first rack portion K1 lifts the pinion gear 46 into mesh with the rack portion 5*a* of slider 5. The first rack portion K1 and pinion gear 46 are also meshed with each other. The pinion gear 46 rotates with the insertion of the first rack portion K1. With this rotation of pinion gear 46, the slider 5 having the rack portion 5*a* meshed with the pinion gear 46 moves in the direction of arrow B in FIGS. 6 and 11. The length of the first rack portion of lock release key K is set such that the amount of movement of slider 5 at this time causes the first presser portion 5*d* of slider 5 to contact the end 41*b* of lock spring 41 but leaves the second presser portion 5*e* out of contact with end 42*b* of lock spring 42. In FIG. 11, the position of pinion gear 46 is shown as after being lifted by the first rack portion K1.

When the first rack portion K1 of lock release key K is inserted into the key insertion bore 45, the movement check spring 47 extending across the key insertion bore 45, whereby the movement check spring 47 is pressed against a wall of the key insertion bore 45. As a result, the free end of movement check spring 47 swings to disengage from the engaging portion 48*a* of set lever 48.

When, with a sliding movement of the slider 5, the first presser portion 5*d* pushes the end 41*b* of lock spring 41, the bulge 41*a* of lock spring 41 retracts from the lock pin insertion bore 40*a*. Thus, the engaging groove 30*a* of lock pin 30 and the bulge 41*a* of lock spring 41 become disengaged.

As a result, the lock pin 30 inserted in the lock pin insertion bore 40*a* is pushed out under the biasing force of coil spring 44*a* inserted in the set lever 48, to change the power supply switch 6 from on state to off state. This stops the power supply to each circuit in the box 2. Thus, the slider 5 acts as a power cutting member for turning off the power supply switch 6.

The timing of this power supply switch 6 changing from on state to off state is slightly delayed from the timing of disengagement between the engaging groove 41*a* of lock pin 30 and the bulge 41*a* of lock spring 41. The piezoelectric buzzer 21 sounds for an instant when the lock release key K is operated to withdraw the lock pin 30 from the lock pin insertion bore 40*a*. The battery V may be checked simultaneously with this withdrawal operation.

After the lock pin 30 is withdrawn from the lock pin insertion bore 40*a*, the lock pin 30 inserted in the lock pin insertion bore 40*b* may also be withdrawn to change the wire unit 3. In this case, the second rack portion K2 of lock release key K is inserted into the key insertion bore 45.

Figure 7:
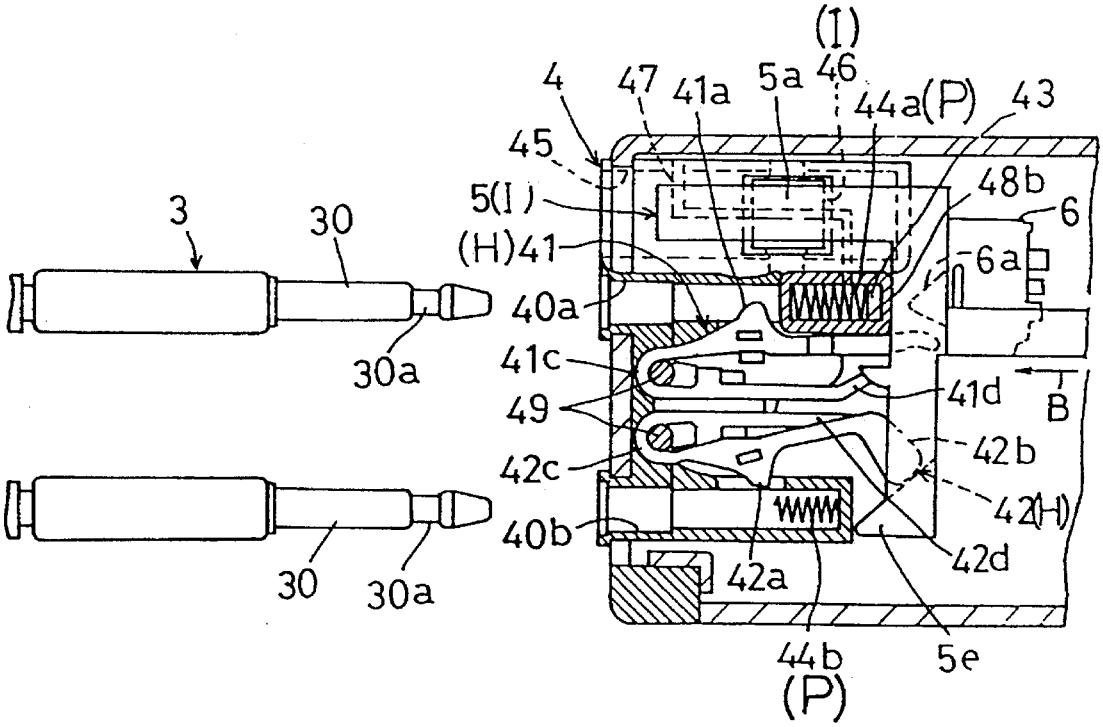
FIG. 7 is a sectional view of the principal portion of the embodiment of FIG. 1.

The second rack portion K2 has a greater insertion depth than the first rack portion K1. Thus, the amount of sliding movement of slider 5 in the direction of arrow B in FIG. 7 is larger when the second rack portion K2 is inserted than when the first rack portion K1 is inserted. As a result, the second presser portion 5*e* of slider 5 and the end 42*b* of lock spring 42 that did not contact each other when the first rack portion K1 was inserted, now contact each other.

When the second presser portion 5*e* pushes the end 42*b* of lock spring 42, as shown in FIG. 7, the bulge 42*a* of lock spring 42 pivots to retract from the lock pin insertion bore 40*b*. This cancels the engagement between the engaging groove 30*a* of lock pin 30 and the bulge 42*a* of lock spring 42.

As a result, the lock pin 30 inserted in the lock pin insertion bore 40*a* is pushed out under the biasing force of coil spring 44*a*.

Thus, the pinion gear 46 and slider 5 act as lock cancellation means for canceling the engagement between the engaging grooves 30*a* of lock pins 30 and lock springs 41, 42 to prevent separation of the box 2 and wire unit 3.

The coil springs 44*a*, 44*b* act as pushout means P for pushing out the lock pins 30 in the direction opposite to the direction of insertion.

Other embodiments are listed below.

(1) The above embodiment exemplifies the sensor tag 1 which is the type attached through the wire unit 3 to a commodity acting as an object of theft prevention. However, there is a type attached to a commodity through a mounting pin 103 as shown in a plan view of FIG. 14(*a*), a front view of FIG. 14(*b*) and a side view of FIG. 14(*c*). With this type, where the object is a garment, for example, the mounting pin 103 is stuck through the cloth, with a tip end of the mounting pin 103 inserted into a box 2.

Figure 14A:
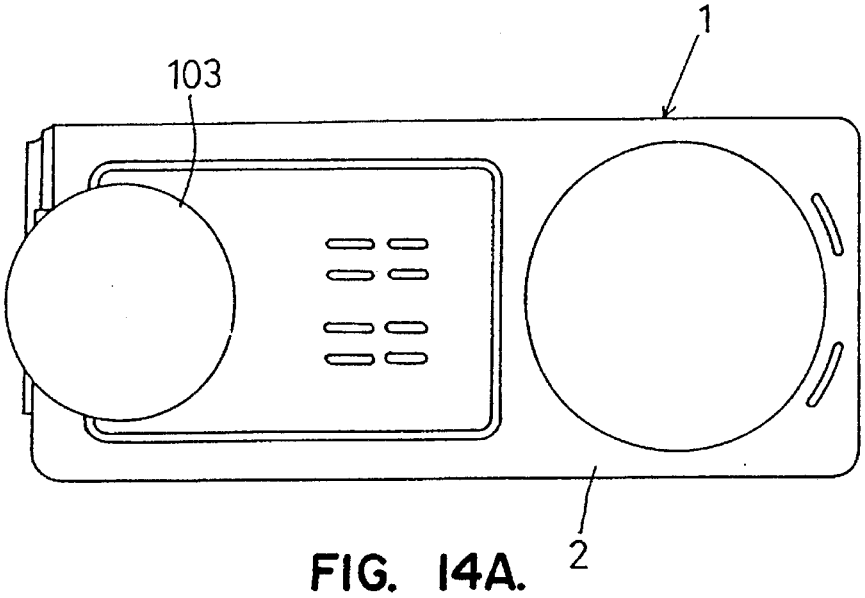

As shown in FIGS. 14(*b*), (*c*), FIG. 19(*b*) and FIG. 20(*b*), the mounting pin 103 includes a shank 103A formed of metal, and a head 103B formed of plastic and holding one end of shank 103A. A disk-shaped metal plate 103*c* is attached to the end of shank 103 held by the head 103B, which is covered by the head 103B and extends perpendicular to the axis of shank 103A. A tip end region of shank 103A defines an engaging groove 103*a* for engaging the box 2.

The outer configuration of head 103B of mounting pin 103 is as a whole spherical, with the side holding the shank 103A presenting a planar surface. That is, the outer configuration of head 103B and the center of gravity balance of mounting pin 103, with the shank 103A formed of metal and the head 103B formed of plastic, are such that the mounting pin 103 will turn over when stood on the head 103B, thus cannot stand still with the tip end of shank 103A pointing upward.

Figure 15:
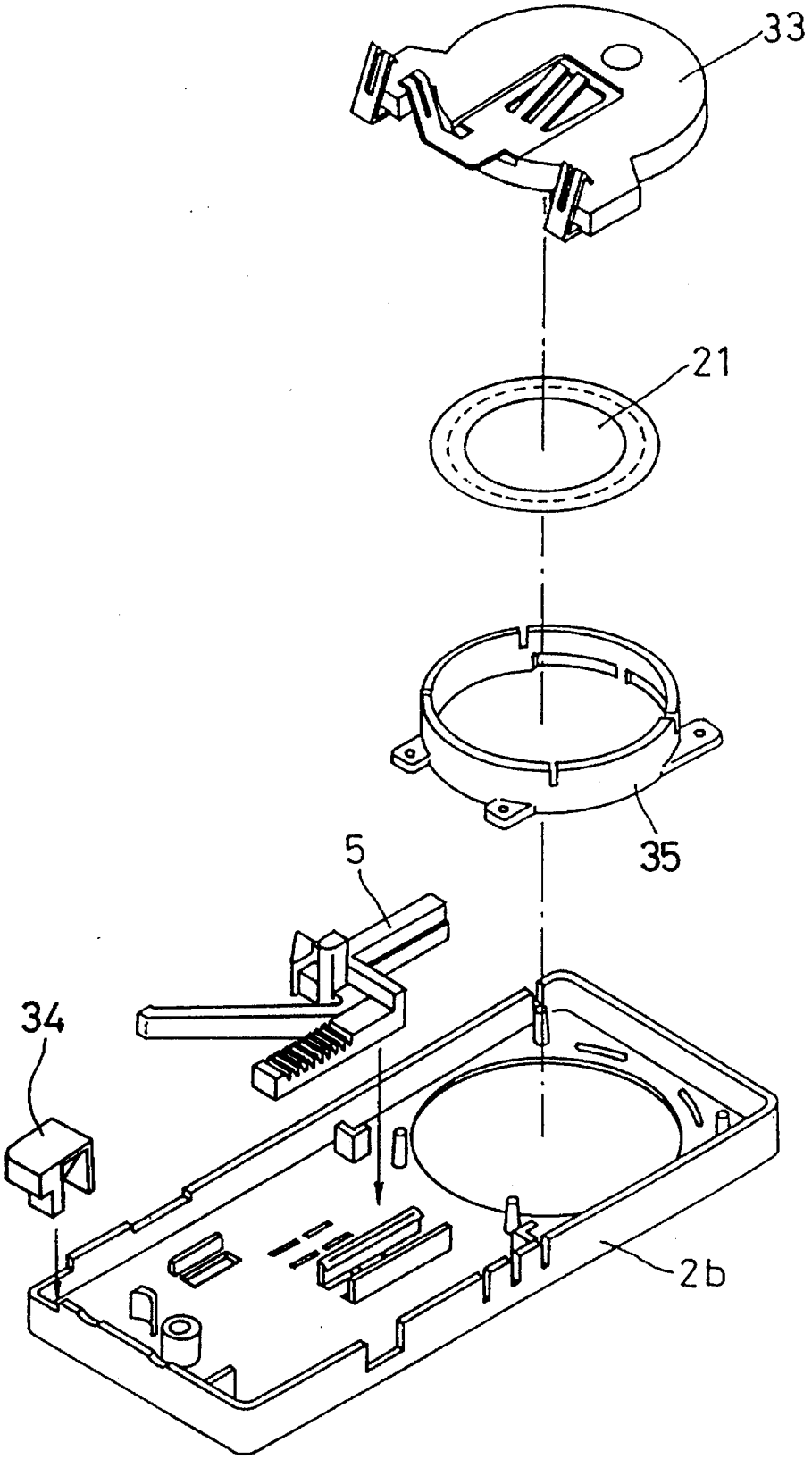
FIG. 15 is an explanatory perspective view of top case components in the embodiment of FIG. 14, FIGS. 16(*a*), (*b*) are explanatory views of outward appearances of a speaker housing in the embodiment of FIG. 14, FIGS. 17(*a*) , (*b*) are explanatory views of outward appearances of a terminal assembly in the embodiment of FIG. 14.

FIG. 15 shows a top case 2*b* of the box 2. The top case 2*b* has, assembled thereto, a speaker housing 35 containing a piezoelectric buzzer 21, the piezoelectric buzzer 21, a flat terminal unit 33, an LED window (light window) 34 for releasing light from an LED lamp 20, and a slider 5.

Figure 18:
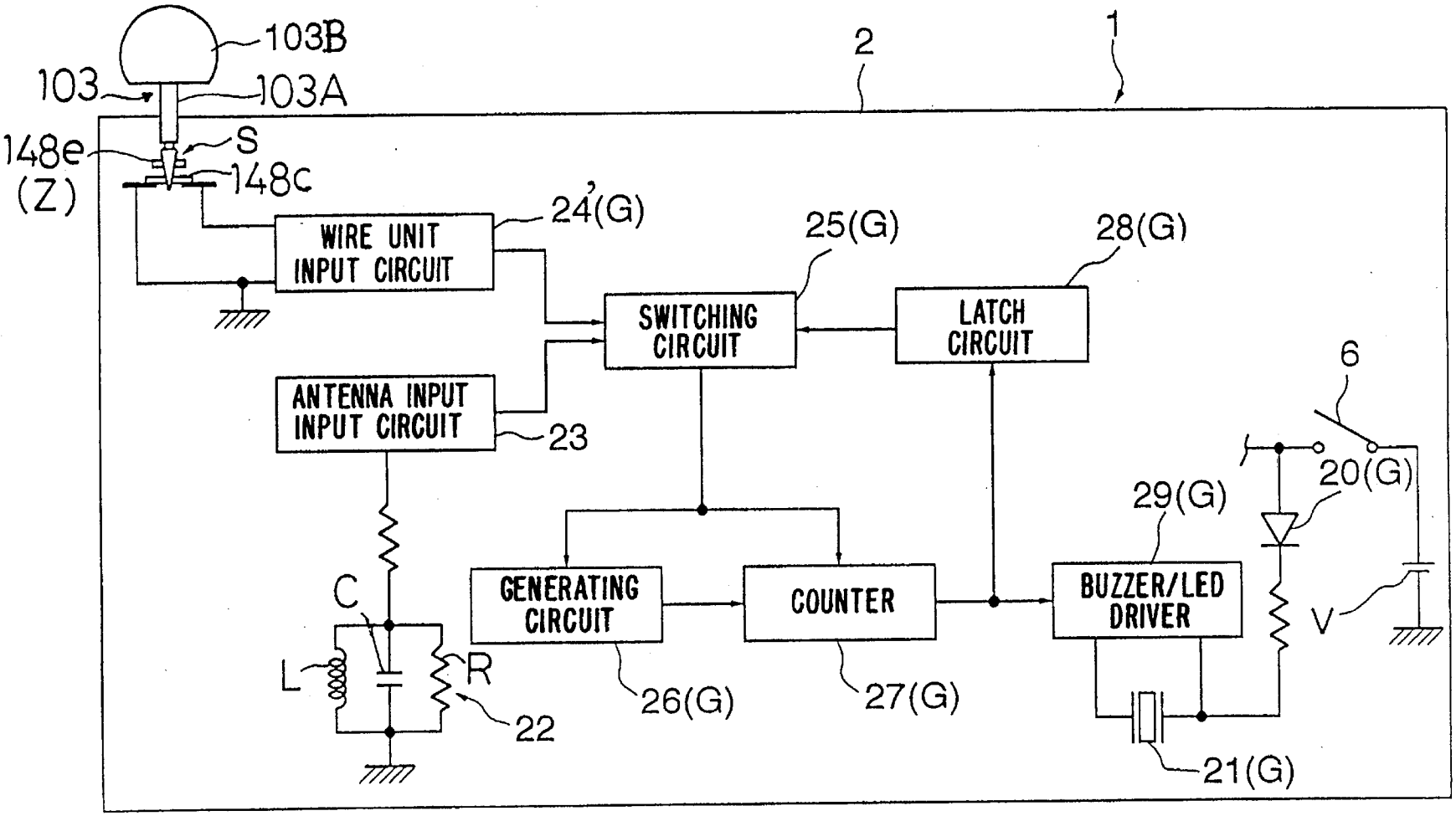
FIG. 18 is a schematic view of the embodiment of FIG. 14, FIGS. 19(*a*), (*b*) are sectional views of a principal portion of the embodiment of FIG. 14, FIGS. 20(*a*), (*b*) are sectional views of the principal portion of the embodiment of FIG. 14, FIGS. 21(*a*) , (*b*) are sectional views of the principal portion of the embodiment of FIG. 14.

Though not shown, a bottom case is opposed to the top case 2*b*, which has a circuit board carrying FIG. 18 a detecting switch S, LED lamp 20, a resonance antenna 22 and various electronic components, and a battery V opposed to the piezoelectric buzzer 21. Thus, the terminal unit 33 is disposed between battery V and piezoelectric buzzer 21.

Figure 14B:
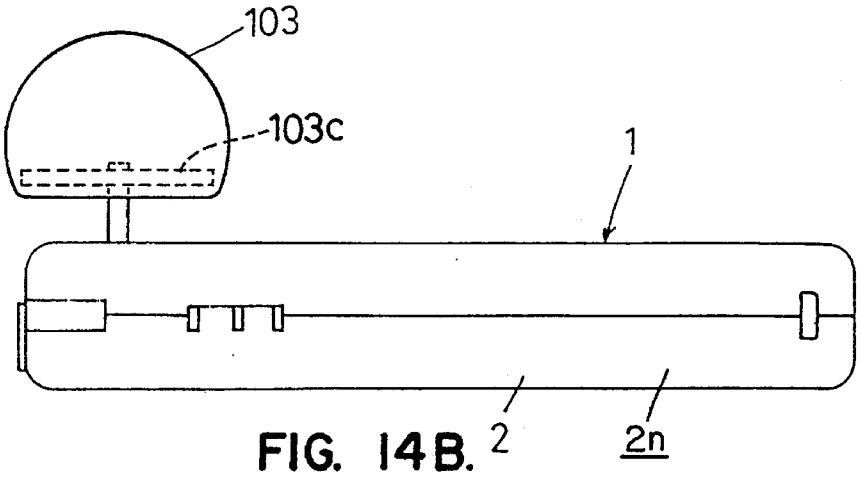

The sensor tag 1 shown in FIG. 14*b* is formed by joining the bottom case 2*a* and top case 2*b* by ultrasonic welding.

Figure 14C:
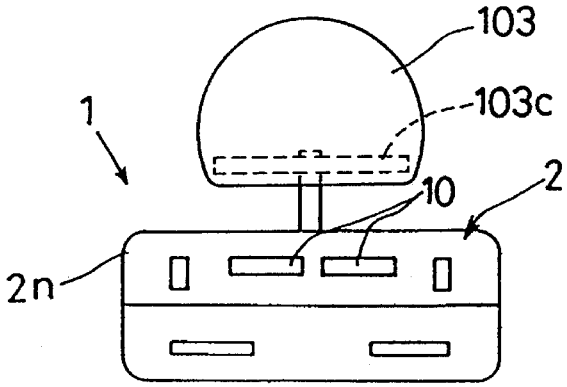

As shown in the side view of FIG. 14*c*, openings 10 are formed in a side surface 2*n* of the box 2. However, openings 10 may be formed in a different side surface (such as side surface 2*d*) as well for releasing an alarm sound.

Then, the openings cannot be blocked up easily, thereby positively preventing a preliminary stealing act to cancel the alarm sound and walk out with the object of theft prevention.

Figure 16A:
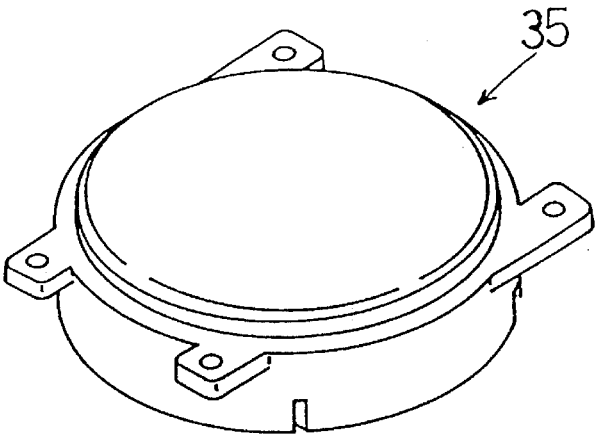
Figure 16B:
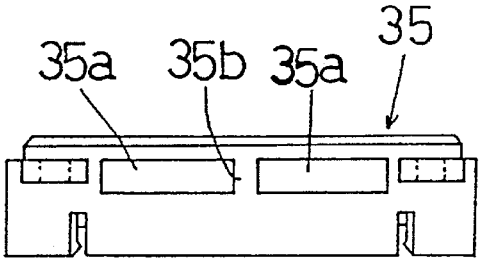
Figure 17A:
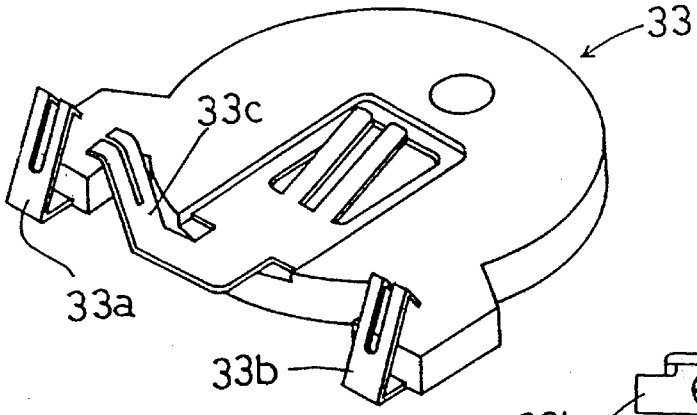
Figure 17B:
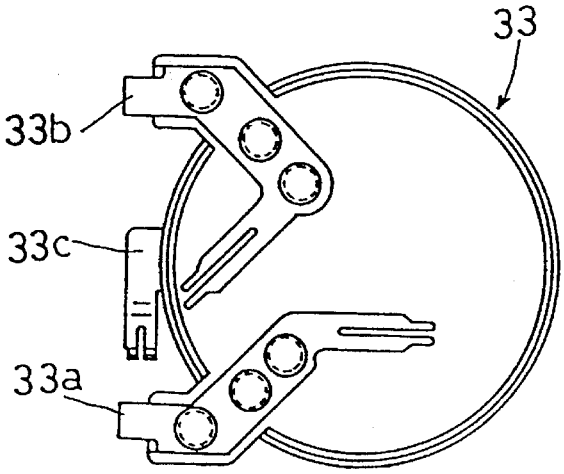

As shown in FIG. 16, the speaker housing 35 has, press fit therein, the piezoelectric buzzer 21 and the terminal unit 33 shown in FIG. 17. The sound generated from the piezoelectric buzzer 21 is released through openings 35*a* to the outside.

A shielding wall not paralleled is provided for shielding the components in the box 2 against exposure to the outside through the openings 10, i.e. for preventing entry of foreign matters through the openings 10.

As shown in FIG. 17, the terminal unit 33 has terminals 33*a*, 33*b* connected to electrodes (+, −) of the piezoelectric buzzer 21 when press fit in the speaker housing 35, and a terminal 33*c* connected to a minus electrode of battery V when the bottom case 2*a* and top case 2*b* are joined by ultrasonic welding.

FIG. 16(*a*) is a perspective view of the speaker housing 35, FIG. 16(*b*) is a rear view of the speaker housing 35, FIG. 17(*a*) is a perspective view of the terminal unit 33, and FIG. 17(*a*) is a bottom view of the terminal unit 33.

The sensor tag 1 shown in FIG. 14 contains a circuitry as shown in FIG. 18.

The circuitry of FIG. 18 is similar to the circuitry of the preceding embodiment shown in FIG. 1. The only difference is that the wire unit 3 is replaced with the mounting pin acting as the attached state detecting member and the member for attaching to an object of theft prevention, and the detecting switch S connected as switch means. When the mounting pin 103 is forcibly pulled out when the power supply switch 6 is turned on, the apparatus operates in the same way as when the wire unit 3 is cut in the preceding embodiment.

The other aspects of operation are the same as in the preceding embodiment, and will not be described again.

A construction for attaching the mounting pin 103 to the box 2 will be described next.

As shown in FIG. 19, the mounting pin 103 is attached to the box 2, as inserted into a mounting pin insertion bore 140 of a jack unit 104 contacting an inner wall of box 2.

As shown in FIGS. 19 and 20, the jack unit 104 has a lock spring 141 in the form of a fishing hook acting as lock means H for engaging and retaining the mounting pin 103 inserted into the mounting pin insertion bore 140. A spring retainer 148 is provided at an end inwardly of lock spring 141 in the direction of insertion of the mounting pin 103.

The lock spring 141 is formed of metal, and has elasticity to move opposite ends 141*a*, 141*b* toward or away from each other.

The lock spring 141 is engaged at a curved portion 141*c* thereof with an engaging projection 149 projecting from a main body of jack unit 104. The end 141*a* of lock spring 141, 42 is fixed to the main body of jack unit 104.

A bulge 141*a* is formed in an intermediate position between the other end 141*b* and curved portion 141*c* of lock spring 141 to be projectable and retractable to engage the engaging groove 103*a* of mounting pin 103.

Figure 22:
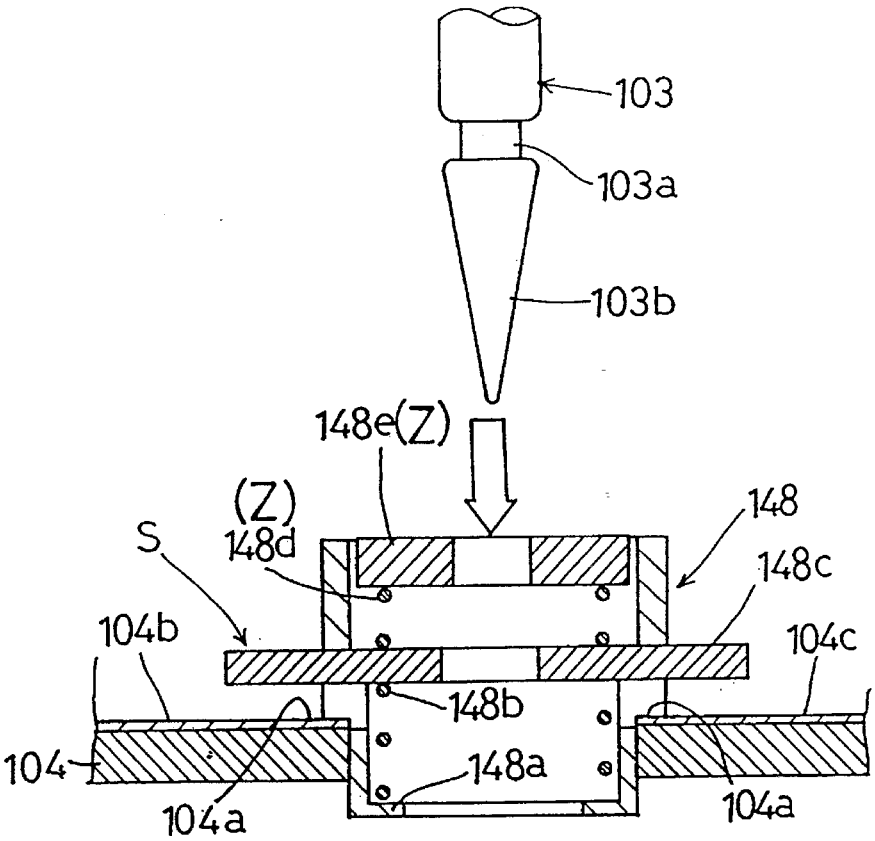
FIG. 22 is a sectional view of a principal portion of the embodiment of FIG. 14.

As shown in FIG. 22, the spring retainer 148 is in the form of two pipes of different diameters placed one over the other. A brim 148*a* is formed at a deep end thereof in the direction of insertion of mounting pin 103. The spring retainer 148 contains a oil spring 148*b* having one end thereof fixed to an inward surface of the brim 148*a*, a metal plate 148*c* supporting the other end of coil spring 148*b*, a coil spring 148*d* having one end thereof fixed to the end of metal plate 148*c* opposite from the surface supporting the end of coil spring 148*b*, and a plastic plate 148*e* supporting the other end of coil spring 148*d*.

Thus, the plastic plate 148*e* and the coil spring 148*d* mounted between the plastic plate 148*e* and metal plate 148*c* act as insulating means Z for electrically insulating the shank 103A and metal plate 148*c*.

The metal plate 148*c* is cut out to define a circular opening centrally thereof to allow passage of a tapered portion 103*b* at the end of mounting pin 103. The plastic plate 148*e* is cut out to define a circular opening centrally thereof to support the tapered portion 103*b* at the end of mounting pin 103.

The metal plate 148*c* penetrates and projects from a side wall of spring retainer 148. The side wall of spring retainer 148 is partly cut out to allow movement of the projecting portion in the direction of insertion of mounting pin 103.

Two divided electrode terminals 104*b*, 104*c* are formed on a mounting surface 104*a* of the main body of jack unit 104 supporting the spring retainer 148. These electrode terminals 104, 104*c* are connected to a mounting pin input circuit 24' disposed in the box 2. The metal plate 148*c* and electrode terminals 104*b*, 104*c* constitute the detecting switch S in FIG. 18.

Adjacent the mounting pin insertion bore 140 is a set button pin insertion bore 130 extending through the jack unit 104 in a direction perpendicular to the direction of pin insertion of mounting pin insertion bore 140. The set button pin insertion bore 130 has a set button pin 131 slidably mounted in the set button pin insertion bore 130. A spring-like contact switch 132 formed of metal is mounted in an end opening of the set button pin insertion bore 140 inwardly of the box 2, with one end thereof fixed to the jack unit 104, to be pivotable when pushed by the set button pin 131.

Figure 24A:
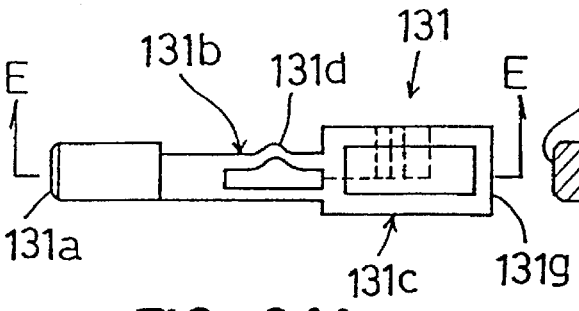
Figure 24B:
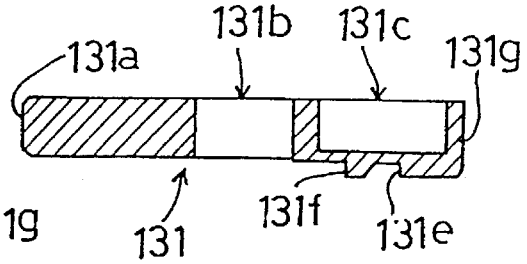

As shown in FIG. 24(*a*) and FIG. 24(*b*) which is a section taken on E—E of FIG. 24(*a*), the set button pin 131 includes an operated portion 131*a* pushed from outside the box 2, a positioning portion 131*b* for positioning the set button pin 131 in a particular location inside the set button pin insertion bore 130, and a spring storing portion 131*c* storing a coil spring 144 for biasing the set button pin 131 in a direction opposite to the inserting direction of the set button pin 131.

Figure 23:
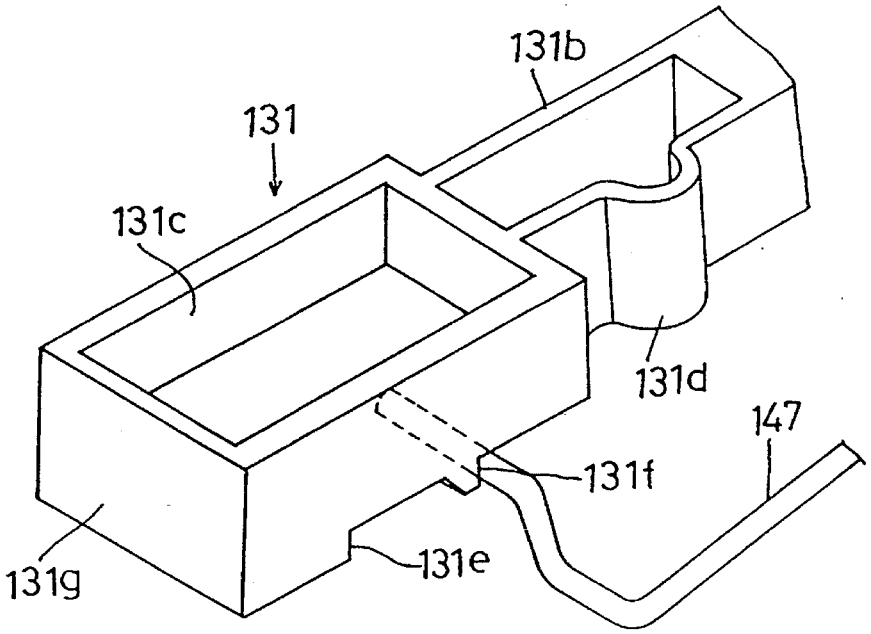
FIG. 23 is a perspective view of the principal portion of the embodiment of FIG. 14, FIGS. 24(*a*), (*b*) are enlarged views of a set button in the embodiment of FIG. 14, FIGS. 25(*a*), (*b*), (*c*) are enlarged views of a slider in the embodiment of FIG. 14, FIGS. 26(*a*), (*b*) are enlarged views of a power source setting jig in the embodiment of FIG. 14, FIGS. 27(*a*), (*b*), (*c*), (*d*) are perspective views of outward appearances of mounting pins in further embodiments, and FIGS. 28(*a*), (*b*) are enlarged views of a mounting pin in a still further embodiment.

As shown in FIG. 23, the spring storing portion 131*c* is in the form of a box having an open side. A projection 143 projects from an inner wall of set button pin insertion bore 140*a* into a space defined by this spring storing portion 131*c* and inner wall of set button pin insertion bore 140*a*. Two engaging portion 131*a*, 131*b* are arranged, in sliding directions of set button pin 131, on a bottom of box-like spring storing portion 131*c* to engage a tip end portion of a movement check spring 147 described later.

The coil spring 144 is disposed between an inner wall, at an outward side of the box 2, of the spring storing portion 131*c* and the projection 143. As noted hereinbefore, the set button pin 131 is biased in the direction opposite to the inserting direction thereof. The positioning portion 131*b* of set button pin 131 has a positioning bulge 131*d* having elasticity to be movable in the projecting direction. An inner wall of the set button pin insertion bore 130 includes a recess 130*a* for engaging the positioning bulge 131*d* when the set button pin 131 is pushed inwardly of the box 2.

When the set button pin 131 is pushed inwardly of the box 2, the end of set button pin 131 inwardly of the box 2 contacts the contact spring 132 to swing the contact spring 132. With this swinging movement, a free end of contact spring 46 touches the circuit board. As a result, the two electrode terminals 106*a*, 106*b* on the circuit board are short-circuited, thereby causing power to be supplied from battery V each circuit in the box 2. This contact spring 132 and two electrode terminals 106*a*, 106*b* correspond to the power supply switch 6 in FIG. 18.

A key insertion bore 145 is formed in a position of set button pin insertion bore 130 remote from the pin insertion bore 140, for receiving a lock release key K to release the mounting pin 103 as described later.

The key insertion bore 145 has, mounted therein, a pinion gear 146 rotatable by the lock release key K inserted into the key insertion bore 145, and the movement check spring 147 for checking movement of the set button pin 131 provided for the set button pin insertion bore 130. These components are similar to those in the preceding embodiment shown in FIG. 11, and are not illustrated in detail.

The pinion gear 146 is rotatably supported in the main body of jack unit 104, with teeth thereof projecting perpendicular to the direction of insertion of the lock release key, and partly projecting into the key insertion bore 145 and partly projecting outside the jack unit 104.

The movement check spring 147 is formed of a thin metal piece to be elastically deformable. The movement check spring 147 has one end thereof fixed to one side adjacent an opening of the key insertion bore 145 to act as a proximal end, to be pivotable through elastic deformation. According to a position in the sliding direction of the set button pin 131, the free end of the movement check spring 147 is pressed by the elastic action of movement check spring 147, to engage one of the engaging portions 131*a*, 131*b* of set button pin 131. The biasing force of coil spring 144 prevents the set button pin 148 from sliding outwardly of the box 2. FIG. 23 shows a state of engagement with the engaging portion 131*f*.

An intermediate portion between the proximal end and free end of movement check spring 147 extends across the key insertion bore 145.

Figure 25A:
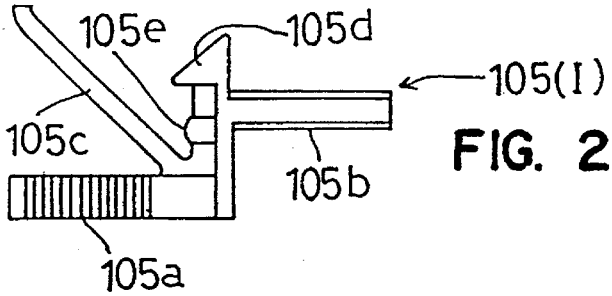
Figure 25B:
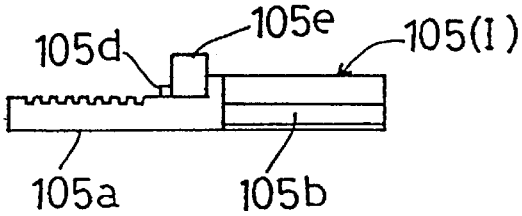
Figure 25C:
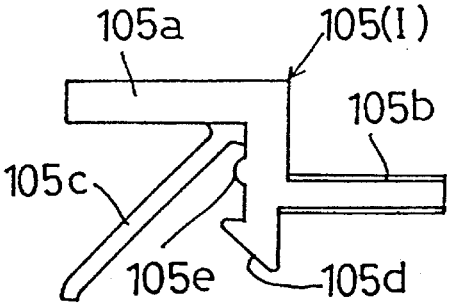

The jack unit 4 includes a slider 105 mounted in a position thereof inwardly of the box 2, as shown in FIGS. 25(*a*), 25(*b*) and 25(*c*), having a rack 105*a* meshed with the portion of pinion gear 146 projecting outside the jack unit 4.

The slider 105 has a proximal portion 105*b* thereof slidably engaging a guide portion, not shown, formed on an inner wall of box 2, which is slidable in directions indicated by arrows e in FIGS. 19–21, i.e. in the directions of insertion and removal of the lock release key K. A forward end of an elastically deformable extension 105*c* extending from an intermediate portion between rack 105*a* and proximal portion 105*b* engages the box 2, so that the elasticity of the extension 105*c* applies a biasing force inwardly of the box. For facility of illustration, the extension 105*c* is omitted from FIGS. 19–21.

Engagement and disengagement between the mounting pin 103 and box 2, and ON/OFF switching of power supply from the battery V to the circuits in the box 2, will be described next.

First, for engaging the mounting pin 103 and box 2, in the state where the mounting pin 103 is disengaged as shown in FIG. 19, the mounting pin 103 is inserted through a button hole or the like in the cloth of a garment F, as shown in FIGS. 20 and 20*b*, and inserted into the mounting pin insertion bore 140 of jack unit 104. As the mounting pin 103 is inserted against the biasing force of coil springs 148*b*, 148*d* (see FIG. 20*b*) provided for the mounting pin insertion bore 140, the bulge 141*d* of lock spring 141 projecting into the mounting pin insertion bore 140 engages the engaging groove 103*a* of mounting pin 103. The biasing force of coil springs 148*b*, 148*d* reliably prevents the mounting pin 103 from moving in the direction of cancellation, to maintain the engaged state.

In the course of insertion prior to engagement between the engaging groove 103*a* of mounting pin and the bulge 141*d* of lock spring 141, the tapered portion 103 at the end of mounting pin 103 contacts the plastic plate 148*e* of jack unit 104. As the mounting pin 103 is further inserted against the biasing force of coil springs 148*b*, 148*d*, the metal plate 148*c* moves inwardly of the box 2 to contact the two electrode terminals 104*b*, 104*c* formed on the mounting surface 104*a* of spring retainer 148, thereby causing a short circuit therebetween. In this state, the detecting switch S shown in FIG. 18 changes from OFF state to ON state. That is, the metal plate 148*c* is in a stopping state to stop output of the alarm output means G. Thus, the metal plate 148*c* acts as an operated member for opening and closing contacts of detecting switch S.

At the point of time when the metal plate 148*c* causes a short circuit of the two divided electrode terminals 104*b*, 104*c*, the coil spring 148*d* still has an allowance for contraction. This allows the plastic plate 148*e* to move toward the metal plate 148*c*. As the mounting pin 103 is inserted further, the mounting pin 103 and lock spring 141 engage each other.

This completes attachment of sensor tag 1 to the commodity. Next, the sensor tag 1 is set in operation.

Figure 26A:
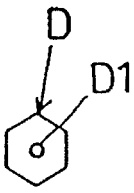
Figure 26B:
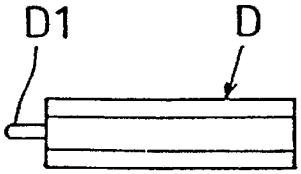
Figure 27A:
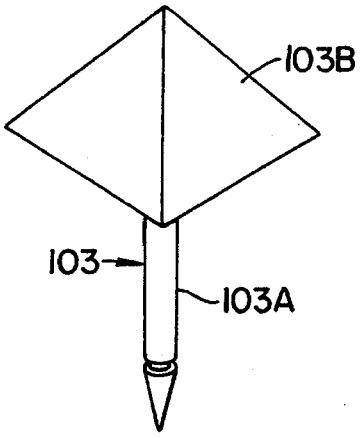
Figure 27B:
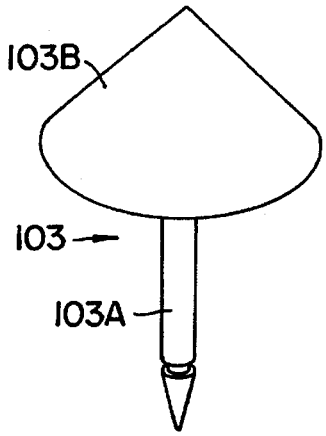
Figure 27C:
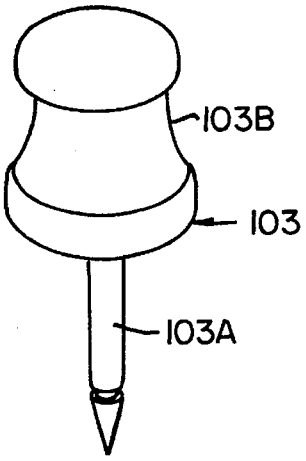
Figure 27D:
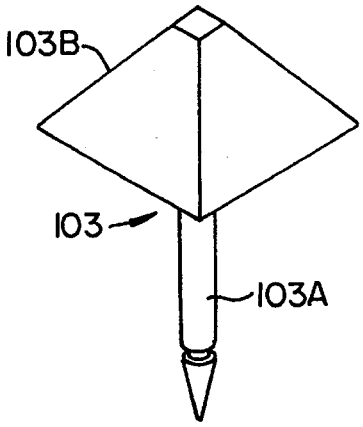

Operation of sensor tag 1 is started by using a power supply setting jig as shown in FIG. 26(*a*), (*b*).

The operated portion 131*a* of set button pin 131 of jack unit 104 is pushed inward with a projecting pin D1 of power supply setting jig D. Then, the end 131*g* of set button pin 131 inwardly of box 2 contacts the contact switch 132, to pivot the contact switch 132. With this pivotal movement, the free end of contact switch 132 touches a circuit board to cause a short circuit of two electrode terminals 106*a*, 106*b* on the circuit board. This starts the power supply from battery V to each circuit in the box 2. A positioning portion 130*b* is formed on an inner wall of the set button pin insertion bore 130 for contacting the spring storing portion 131*c* of set button pin 131 so that, in the state that the set button pin 131 is not pushed in, the operated portion 131*a*, which is an outer end of box 2 outside edge, of set button pin 131 is slightly indented from the opening of set button pin insertion bore 130 outwardly of the box 2.

When this set button pin 131 is pushed, the free end of movement check spring 147 engaged with the engaging portion 131*e* of set button pin 131 switches to a position to engage the engaging portion 131*f* of set button pin 131 as shown in FIG. 23.

In the position where the set button pin 131 causes the free end of contact switch 132 to pivot toward the circuit board, the coil spring 144 is compressed to push the set button pin 131 outwardly of the box 2. However, a sliding movement of set button pin 131 is prevented by the engagement between the free end of movement check spring 147 and the engaging portion 131*f* of set button pin 131 as noted above. A sliding movement of set button pin 131 is prevented also by the engagement between the positioning bulge 131*d* of set button pin 131 and the engaging recess 130*a* of set button pin insertion bore 130.

When, with the power supply switch 6 turned on, the mounting pin 103 are pulled out forcibly, the metal plate 148*c* moves away from the electrode terminals 104*b*, 104*c* under the return biasing force of coil spring 148*b*. Consequently, an output control state is established in which the alarm output means G outputs an alarm.

Next, the lock release key K shown in FIG. 10 is used as in the preceding embodiment for disengaging the mounting pin 103 and jack unit 104 in the state shown in FIG. 20.

In the state shown in FIG. 20, when the second rack portion K2 is inserted into the key insertion bore 145, the second rack portion K2 and pinion gear 146 mesh with each other, whereby the pinion gear 146 rotates with the insertion of the second rack portion K2. With the rotation of this pinion gear 146, the slider 105 having the rack portion 105*a* meshed with the pinion gear 146 moves from the position shown in a dot-and-dash line to the position shown in a solid line in FIG. 21. When the second rack portion K2 of lock release key K is inserted into the key insertion bore 145, the movement check spring 147 extending across the key insertion bore 145 is pressed whereby the movement check spring 147 is pressed against a wall of the key insertion bore 145. This causes the free end of movement check spring 147 to pivot, thereby disengaging the free end from the engaging portion 131*f* of set button pin 131.

The slider 105 has a first presser portion 105*d* for contacting the end 141*b* of lock spring 141, and a second presser portion 105*e* for contacting the end of the set button pin inwardly of the box 2, with the sliding movement of slider 105. When the first presser portion 105*d* pushes the end 141*b* of lock spring 141, as shown in FIG. 21, the bulge 141*d* of lock spring 141 pivots out of the mounting pin insertion bore 140. This disengages the engaging groove 103*a* of mounting pin 103 and the bulge 141*d* of lock spring 141. The mounting pin 103 is pushed out of the box 2 under the biasing force of coil springs 148*b*, 148*d* of spring retainer 148. Thus, the slider 105 acts as lock release means I for canceling the detachment preventive operation of lock spring 141 preventing separation of box 1 and mounting pin 103. On the other hand, when the second presser portion 105*e* pushes the end of set button pin 131 inwardly of the box 2, the set button pin 131 moves outwardly of the box 2. This disengages the positioning bulge 131*d* of set button pin 131 and the engaging recess 130*a* of set button insertion bore 130.

As a result, the set button pin 131 returns to the state prior to the depression of operated portion 131*a*, under the biasing force of coil spring 144 in the spring storing portion 131*c*. The contact switch 132 moves away from the two terminals on the circuit board, to stop the power supply from the battery V to the circuits in the box 2. Thus, the slider 105 acts as a power cutting member for turning off the power supply switch 6.

The timing of this power supply stoppage is slightly delayed from the timing of disengagement between the engaging groove 103*a* of mounting pin 103 and the bulge 141*a* of lock spring 141. The piezoelectric buzzer 21 sounds for an instant when the lock release key K is operated to withdraw the mounting pin 103 from the lock pin insertion bore 140. The battery V may be checked simultaneously with this withdrawal operation.

The alarm outputting device may comprise, instead of piezoelectric buzzer (piezoelectric type buzzer) 21, a different type of buzzer such as the electrostatic type (but not transmitting an electric wave).

(2) Instead of using the lock pins 30 or mounting pin 103 acting as the attached state detecting device also as the device for attaching the box 2 to an object of theft prevention, an operated portion of a switch may be provided as the attached state detecting device to project from the box 2 and contact the object of theft prevention touch. This attached state detecting device does not have the function to attach the box to the object of theft prevention.

In this case, the box may be attached to the object of theft prevention with adhesive tape or the like.

(3) The alarm output means may output an electric wave signal as an alarm instead of outputting an alarm by sounding the piezoelectric buzzer 21, with a device additionally provided for giving an alarm when the electric wave signal is received.

Or, instead of outputting an alarm by lighting the LED lamp 20 and sounding the piezoelectric buzzer 21 a device for transmitting an electric wave may be provided for the box 2, with a device provided in any other position for receiving the electric wave from the transmitting device and giving an alarm sound or the like. When a disconnection between box 2 and lock pin 30 is detected, the electric wave is transmitted from the transmitting device to output the alarm.

(4) In the different embodiment described above, The mounting pin 103 is unlocked with different timing to the power supply switch 6 being turned off by the set button pin 131, to sound the piezoelectric buzzer 21 for an instant to enable battery checking. A sensor may be provided for detecting the turning off of the power supply switch 6, and the piezoelectric buzzer 21 may be sounded for an instant based on detection information from the sensor.

(5) In the foregoing embodiment, the engaging portions 48*a*, 48*b* of set lever 48 for pushing the operated portion 6*a* of power supply switch 6 are provided on one side of set lever 48 in plan view. The engaging portions 48*a*, 48*b* may be arranged in point symmetry about the center of set lever 48 in plan view, make unnecessary a confirmation of the direction of insertion when the set lever 48 is inserted into the lock pin insertion bore 40*a*.

(6) In the foregoing embodiment, the lock pins 30 are retained in place by the engagement between the engaging grooves 30*a* of lock pins 30 and the lock springs 41, 42 acting as lock means H. The lock means H may comprise brake shoes for clamping the lock pins 30 therebetween.

(7) In the different embodiment, the coil spring 148*d* of spring retainer 148 provides an allowance after the metal plate 148*c* contacts the electrode terminals 104*b*, 104*c*. The metal plate 148 itself may have elasticity to integrate the function of coil spring 148*d*.

(8) In the foregoing embodiment, the wire unit 3 is electrified, and a disconnection of box 2 and wire unit 3 is detected based on de-electrification thereof. However, the wire unit 3 may be formed of optical fiber, and the disconnection may be connected based on whether light emitted from the box 2 returns to the box 2 by way of the wire unit 3.

Instead of using the wire unit 3 as mounting device, an approximately C-shaped steel wire having engageable portions at opposite ends similar to the engaging grooves 30*a* of lock pins 30 may be used as mounting device.

(9) In the foregoing embodiment, the lock pins 30 at the opposite ends of wire unit 3 are detached from the box 2 independently of each other. The lock pins 30 at the opposite ends may be detached simultaneously from the box 2. In the foregoing embodiment, for example, when the lock pins 30 at the opposite ends are inserted in the box 2, the second rack portion K2 of lock release key K may be inserted in the key insertion bore 45 to achieve the above simultaneous detachment.

(10) In the foregoing embodiment, the coil springs 44*a*, 44*b* act as the pushout means P for pushing out the lock pins 30. The coils springs 44*a*, 44*b* may be replaced with helical springs or the like.

The slider 5 may include push rods for pushing the forward ends of lock pins 30, whereby the lock pins 30 are pushed out with a sliding movement of the slider 5.

(11) In the foregoing embodiment, the switch means S includes the coil spring 148*d* mounted between the plastic plate 148*e* and metal plate 148*c* pushed by the shank 103A of mounting pin 103. After the metal plate 148*c* is stopped, the plastic plate 148*e* is allowed to move toward the metal plate 148*c*. The metal plate 148*c* may be a thin plate appropriately curved to bulge toward the mounting pin 103, so that the plastic plate 148*e* directly pushes the metal plate 148*c*. In this case also, the plastic plate 148*e* may be allowed to move toward the metal plate 148*c* after the metal plate 148*c* is stopped.

(12) In the foregoing embodiment, the insulating means Z has the plastic plate 148*e* and coil spring 148*d*. The plastic plate 148*e*, which is an insulator, electrically insulates the shank 103A of mounting pin 103 and the metal plate 148*c*.

However, electric insulation may be provided by an insulating film applied to the shank 103A or the surface of metal plate 148*c* opposed to the mounting pin 103.

The plastic plate 148*e*, which is an insulator, has a plate form, but may be modified in various ways such as being cylindrical. The plastic plate 148*e* may be replaced with a ceramic plate or the like to act as an insulator.

(13) In the foregoing embodiment, the detecting switch S is what is known as a normally open type switch. This may be what is known as a normally closed type switch changeable from ON state to OFF state when pushed by the mounting pin 103.

Conductive rubber or the like may be used instead of using the metal plate 148*c* as the operated portion of switch means S.

(14) In the foregoing embodiment, the head 103B of mounting pin 103 has an approximately spherical outer configuration. This shape is variable in many ways as shown in FIG. 27, only if shaped to promote its turning over when the mounting pin 103 is stood on the head 103B. For example, it may be pyramid-shaped as shown in FIG. 27(*a*), conical as shown in FIG. 27(*b*), or it may include a curved surface at an end remote from the shank 103A as shown in FIG. 27(*c*). As shown in FIG. 27(*d*), the pyramid shape shown in FIG. 27(*a*) may be modified to have the end remote from the shank 103A cut to define a plane. For its turning over is promoted when the mounting pin 103 is stood as noted above, if the cut part has a small area.

The mounting pin 103 includes the approximately spherical head 103B formed of plastic and the shank 103A formed of metal, and its center of gravity balance is such that the mounting pin 103 will turn over when stood on the head 103B. Such center of gravity balance may be obtained by using a material of great specific gravity such as metal or ceramic for forming only the forward end of shank 103A remote from the head 103B. Alternatively, such center of gravity balance may be obtained by means of a weight such as of lead embedded in the end of shank 103A adjacent the plastic head 103B, combined with the various outer configurations of head 103B in the foregoing embodiment and different embodiment described hereinbefore.

Figure 28A:
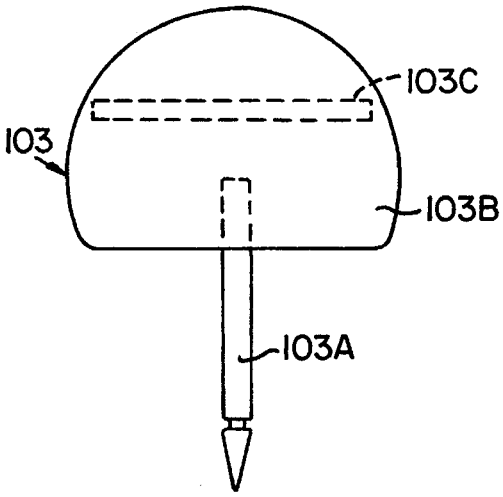
Figure 28B:
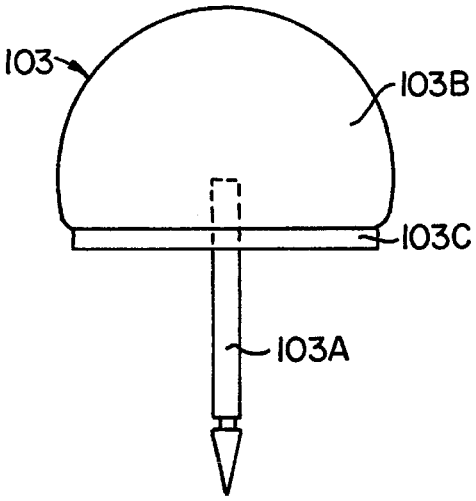

(15) In the foregoing embodiment, the metal plate 103*a* of mounting pin 103 is attached to the shank 103A inside the head 103B. As shown in FIG. 28(*a*) , it may be mounted inside the head 103B separately from the end of shank 103A and extending perpendicular to the axis of shank 103A. Alternatively, as shown in FIG. 28(*b*), it may be attached to the surface of head 103B adjacent the shank 103A.

(16) The piezoelectric buzzer 21 and LED lamp 20 of the alarm output means G have been described as being mounted in the box 2. However, the piezoelectric buzzer 21 and LED lamp 20 may be provided separately from the box 2. Then, the piezoelectric buzzer 21 and LED lamp 20 give an alarm upon receipt of an electric wave transmitted from the alarm output means G in the box 2.

(17) In the foregoing embodiment, the alarm control means G of sensor tag 1 operates the piezoelectric buzzer 21 and LED lamp 20 upon detection of withdrawal of the mounting pin 103 from the box 2 and approach to the transmitter O. The alarm output means G may constantly transmit an electric wave, and the piezoelectric buzzer 21 and LED lamp 20 may be installed at an entrance or the like of a shop for receiving the electric wave. In this case, the piezoelectric buzzer 21 and LED lamp 20 give an alarm when the sensor tag 1 approaches the piezoelectric buzzer 21 and LED lamp 20 which receive the electric wave transmitted from the alarm output means G.

(18) In the foregoing embodiment, the set button pin 131, under the biasing force of coil spring 144, returns to the state prior to being pushed in, but may return only by pushing action of the slider 105, without requiring the coil spring 144.

The elasticity of the positioning bulge 131*d* of set button pin 131 may be increased to a certain degree, so that a return may be made by using the return biasing force of positioning bulge 131*d* when the positioning bulge 131*d* passes along a slope, outwardly of the box 2, of the projection corresponding to an edge, outwardly of the box 2, of the engaging recess 130*a*.

(19) In the foregoing embodiment, when adjusting the reception sensitivity of resonance antenna 22 by varying the resistance value of resistor R, the adjustment is made by replacing the resistor R with an appropriate one. However, a variable resistor may be used as resistor R, the reception sensitivity of the resonance antenna being adjusted by adjusting the resistance value of the variable resistor.

We claim:

1. A theft preventive apparatus comprising:

an attached-state detecting device exposed outside a box for detecting a state of attachment to an object of theft prevention, alarm output means mounted in said box for detecting removal of said box from the object of theft prevention based on information from said attached-state detecting device and outputting an alarm at the time of detection of the removal, a battery mounted in said box for driving said alarm output means, and a power supply switch for a turning power supply on and off between said battery and said alarm output means;

wherein said attached-state detecting device comprises a mounting member connected to said box, and said power supply switch is changeable from off state to on state when said mounting member is connected to said box.

2. A theft preventive apparatus as defined in claim 1, wherein said box contains a turn-off member for turning off said power supply switch and a pinion gear meshed with a rack portion of said turn-off member, said pinion gear being rotatable by a control member having rack portions at opposite ends thereof, to turn off said power supply switch.

3. A theft preventive apparatus as defined in claim 2, wherein said box (2) includes:

lock means (H) for preventing separation of said box (2) and said mounting member, and lock release means (I) for canceling separation preventive action of said lock means (H), said lock release means (I) being operable with an operation of said control member (K) to turn off said power supply switch (6).

4. A theft preventive apparatus as defined in claim 2, wherein said alarm output means outputs an alarm with an operation of said control member to turn off said power supply switch.

5. A theft preventive apparatus as defined in claim 2, wherein said rack portions (K1, K2) of said control member (K) comprise a first rack portion (K1) and a second rack portion (K2) having different lengths, only one end of said control member being unlocked when said first rack portion (K1) of smaller length is inserted into an insertion bore, and opposite ends of said control member being unlocked when said second rack portion (K2) of greater length is inserted into the insertion bore.

6. A theft preventive apparatus as defined in claim 1, wherein said attached state detecting device (3) includes connectors (30) arranged at opposite ends thereof for insertion into and removal from said box (2), said connectors (3) having engageable portions (30*a*), said box (2) including engaging members (41, 42) biased toward engaging positions for engaging said engageable portions (30*a*), said box (2) including a lock release means (I) for canceling engagement between said engageable portions (30*a*) and said engaging members (41, 42).

7. A theft preventive apparatus as defined in claim 6, further comprising push-out means (P) for pushing out said connectors (30) in a direction opposite to a direction of insertion, upon an operation of said lock release means (I) for disengaging said engageable portions (30*a*) and said engaging members (41, 42).

8. A theft preventive apparatus as defined in claim 1, wherein said attached state detecting device (103) includes a shank (103A) insertable into said box (2), said box (2) housing switch means (S) for controlling power supply to said alarm output means (G) such that said alarm output means (G) is placed in an output halt state when said shank (103A) is inserted into said box (2), and said alarm output means (G) is placed in an outputting state when said shank (103A) is removed from said box (2), said switch means (S) having a contact opening and closing conductive operated portion (148*c*) pushed when said shank (103A) is inserted into said box (2) to place said alarm output means (G) in the output halt state, and biased toward an outputting position to place said alarm output means (G) in the outputting state, insulating means (Z) being provided for electrically insulating said operated portion (148*c*) and said shank (103A).

9. A theft preventive apparatus as defined in claim 8, wherein said insulating means (Z) includes an insulator (148*e*) pushed by said shank (103A) inserted into said box (2), and elastic means (148*d*) disposed between said insulator (148*e*) and said operated portion (148*c*) for pushing said operated portion (148*c*) to said halt state when said insulator (148*e*) is pushed by said shank (103A), and for allowing said insulator (148*e*) to move toward said operated portion (148*c*) after said operated portion (148*c*) is moved to said halt state.

10. A theft preventive apparatus as defined in claim 8, wherein said attached state detecting device (103) includes a head (103B) attached to one end of the shank (103A) and having a larger diameter than the shank, said head (103B) of said attached state detecting device (103) having an outer configuration to promote a turnover said attached state detecting device (103) stood on said head (103B), and said attached state detecting device (103) having a center of gravity balance to promote a turnover of said attached state detecting device (103) stood on said head (103B).

11. A theft preventive apparatus as defined in claim 10, wherein said head (103B) of said attached state detecting device (103) is formed of plastic, with a metal plate (103*a*) mounted inside said head (103B) or on an end surface thereof opposed to said shank (103A) to cross an axis of said shank (103A).

12. A theft preventive apparatus as defined in claim 1, wherein said battery (V) for supplying power to said alarm sound output means (21) and said alarm sound output means (21) are opposed to each other inside said box (2), a flat terminal unit (33) having a terminal connected to a terminal of said battery (V) and a terminal connected to an electrode of said alarm sound output means (21) being disposed between said battery (V) and said alarm sound output means (21).

13. A theft preventive apparatus as defined in claim 12, wherein said alarm sound output means (21) is operable to output an intermittent sound as the alarm sound.

14. A theft preventive apparatus as defined in claim 13, wherein said box (2) has sound release openings (10) formed in a side surface thereof for releasing the alarm sound outputted from said alarm sound output means (21) outside said box (2).

15. A theft preventive apparatus as defined in claim 14, wherein said box (2) has a shield wall (32*b*) mounted therein for shielding components in the box (2) against exposure through said openings (10).

16. A theft preventive apparatus as defined in claim 1, wherein said box (2) includes receiver means (22) for receiving a medium of information communication transmitted from a transmitter (O) installed in a particular location, said reception means (22) comprising a resonance antenna for operating said alarm output means (G) upon receipt of the electric wave from said transmitter (O), and having a coil (L), a capacitor (C) and a resistor (R) in parallel connection.

* * * * *